US007307603B2

(12) United States Patent
Onozawa et al.

(10) Patent No.: US 7,307,603 B2
(45) Date of Patent: Dec. 11, 2007

(54) DRIVING CIRCUIT, DRIVING METHOD, AND PLASMA DISPLAY DEVICE

(75) Inventors: Makoto Onozawa, Kawasaki (JP); Tomokatsu Kishi, Kawasaki (JP); Tetsuya Sakamoto, Kawasaki (JP); Akihiro Takagi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 613 days.

(21) Appl. No.: 10/956,161

(22) Filed: Oct. 4, 2004

(65) Prior Publication Data

US 2005/0140309 A1 Jun. 30, 2005

(30) Foreign Application Priority Data

Dec. 24, 2003 (JP) ..... 2003-427679

(51) Int. Cl.
*G09G 3/28* (2006.01)

(52) U.S. Cl. ..... 345/68; 345/60; 345/63

(58) Field of Classification Search ..... 345/60–70, 345/211, 690

See application file for complete search history.

(56) References Cited

U.S. PATENT DOCUMENTS 6,538,627 B1 * 3/2003 Whang et al. ..... 345/60

6,888,518 B2 * 5/2005 Roh et al. ..... 345/68

FOREIGN PATENT DOCUMENTS

EP 1 065 650 1/2001

OTHER PUBLICATIONS

T. Kishi, et al., "A New Drving Technology for PDP's with Cost Effective Sustain Circuit," *SID 01 Digest*, 2001 (pp. 1236-1239).

* cited by examiner

*Primary Examiner*—Duc Q Dinh
(74) *Attorney, Agent, or Firm*—Staas & Halsey LLP

(57) ABSTRACT

A first and a second signal line respectively supplying a first potential and a second potential to one end of a capacitive load, a waveform output circuit whose input terminal is connected to a supply line supplying a third potential, whose output terminal is connected to the first or the second signal line, and whose control terminal is connected to a waveform generating circuit, and a reactive current preventing switch connected between the control terminal and the output terminal or the input terminal of the waveform output circuit are provided. During a period when a reactive current is prevented from flowing, the reactive current preventing switch is bought into conduction to make a potential difference between the control terminal and the output terminal of the waveform output circuit smaller so that the waveform output circuit cannot be operated, which prevents the reactive current from flowing, leading to an improvement in the reliability of a driving circuit.

25 Claims, 22 Drawing Sheets

DRIVING CIRCUIT, DRIVING METHOD, AND PLASMA DISPLAY DEVICE

CROSS-REFERENCE TO RELATED APPLICATIONS

This application is based upon and claims the benefit of priority from the prior Japanese Patent Application No. 2003-427679, filed on Dec. 24, 2003, the entire contents of which are incorporated herein by reference.

BACKGROUND OF THE INVENTION

1. Field of the Invention

The present invention relates to a driving circuit and a driving method of a matrix type flat panel display device, and a plasma display device using the driving circuit and the driving method.

2. Description of the Related Art

Conventionally, plasma display devices, particularly, AC-driven Plasma Display Panels (PDPs), which are one of matrix type flat panel display devices, come in two types: 2-electrode type PDPs which perform selective discharge (address discharge) and sustain discharge between two electrodes and 3-electrode type PDPs which perform address discharge using a third electrode. Moreover, there are two structure types for the 3-electrode type PDPs. One type has the third electrode being formed on a substrate on which a first electrode and a second electrode to perform sustain discharge therebetween are placed. The other type has the third electrode being formed on another substrate opposite to the substrate of the first and second electrodes.

The aforementioned respective types of PDP devices are based on the same principle of operation, and hence, an example of the structure of the PDP device in which the first and second electrodes to perform sustain discharge therebetween are provided on a first substrate and the third electrode is additionally provided on a second substrate opposite to the first substrate will be explained below.

FIG. 15 is a diagram showing an overall configuration of an AC-driven PDP device. In FIG. 15, the AC-driven PDP device 1 includes plural cells arranged in a matrix form, each cell representing one pixel of a display image. The respective cells are arranged in a matrix with m rows and n columns, as shown by cells Cmn in FIG. 15. In the AC-driven PDP device 1, scan electrodes Y1 to Yn and common electrodes X parallel to each other are provided on a first substrate, and address electrodes A1 to Am are provided in a direction orthogonal to these electrodes Y1 to Yn and X on a second substrate opposite to the first substrate. The common electrodes X are arranged corresponding to and adjacent to the respective scan electrodes Y1 to Yn, and one ends thereof are connected to one another in common.

A common terminal of the common electrodes X is connected to an output terminal of an X-side circuit 2, and the scan electrodes Y1 to Yn are respectively connected to output terminals of a Y-side circuit 3. The address electrodes A1 to Am are connected to output terminals of an address-side circuit 4. The X-side circuit 2 is composed of a circuit which repeats electric discharge. The Y-side circuit 3 is composed of a circuit which performs line-sequential scanning and a circuit which repeats electric discharge. The address-side circuit 4 is composed of a circuit which selects a column to be displayed.

The X-side circuit 2, Y-side circuit 3, and address-side circuit 4 are controlled by control signals supplied from a control circuit 5. Namely, a display operation of the PDP device is carried out by determining which cell to be lighted by the address-side circuit 4 and the circuit which performs line-sequential scanning in the Y-side circuit 3 and then by repeating electric discharge by the X-side circuit 2 and the Y-side circuit 3.

The control circuit 5 generates the control signals based on display data D, a clock CLK indicating a timing at which the display data D is read, a horizontal synchronization signal HS, and a vertical synchronization signal VS which are supplied from the outside, and supplies these control signals to the X-side circuit 2, the Y-side circuit 3, and the address-side circuit 4.

FIG. 16A is a diagram showing a cross sectional structure of a cell Cij at an i-th row and a j-th column as one pixel. In FIG. 16A, the common electrode X and a scan electrode Yi are formed on a front glass substrate 11. Over them, a dielectric layer 12 is deposited as insulation against a discharge space 17. Further, an MgO (magnesium oxide) protective film 13 is deposited over the dielectric layer 12.

On the other hand, an address electrode Aj is formed on a rear glass substrate 14 which is placed opposite the front glass substrate 11. A dielectric layer 15 is deposited over the address electrode Aj. Further, a phosphor 18 is deposited over the dielectric layer 15. Ne+Xe penning gas or the like is filled into a discharge space 17 between the MgO protective film 13 and the dielectric layer 15.

FIG. 16B is a diagram for explaining a capacitance Cp of the AC-driven PDP device. As shown in FIG. 16B, in the AC-driven PDP device, there are capacitive components Ca, Cb, and Cc in the discharge space 17, between the common electrode X and the scan electrode Yi, and in the front glass substrate 11, respectively. A capacitance Cpcell per cell is determined by summing up these capacitive components (Cpcell=Ca+Cb+Cc). A panel capacitance Cp is obtained by summing up the capacitances Cpcell of all cells.

FIG. 16C is a diagram for explaining light emission of the AC-driven PDP device. As shown in FIG. 16C, red, blue, and green phosphors 18 are arranged and painted in a stripe pattern on inner surfaces of ribs 16, and the phosphors 18 are exited by electric discharge between the common electrode X and the scan electrode Y to emit light.

One of methods for reducing the circuit cost of a plasma display device such as described above is a method disclosed in EP Patent Application Publication No. 1065650 and "SID 01 DIGEST", pp. 1236-1239, "A New Driving Technology for PDPs with Cost Effective Sustain Circuit". This method is a method in which electric discharge is performed using a potential difference between sustain discharge electrodes by applying a first voltage to one of the sustain discharge electrodes (common electrode X and scan electrode Y) and applying a second voltage different from the first voltage to the other electrode. A circuit to realize this driving method is called a TERES (Technology of Reciprocal Sustainer) circuit.

FIG. 17 is a diagram showing a schematic configuration of the TERES circuit. (Note that only the X-side circuit 2 will be explained, and the Y-side circuit 3 is omitted since it has the same configuration and operation.)

In FIG. 17, a capacitive load 20 (hereinafter referred to as "a load 20") is the total capacitance of the cells Cmn formed between one common electrode X and one scan electrode Y. The common electrode X and the scan electrode Y are formed in the load 20. The scan electrode Y here is any scan electrode out of the plural scan electrodes Y1 to Yn.

Switches SW1 and SW2 are connected in series between a power supply line with a voltage (Vs/2) supplied from a power supply and a ground (GND). One terminal of a capacitor C1 is connected to an interconnection node between the two switches SW1 and SW2, and a switch SW3 is connected between the other terminal of the capacitor C1 and the ground. Incidentally, a signal line connected to the one terminal of the capacitor C1 is referred to as a first signal line OUTA, and a signal line connected to the other terminal is referred to as a second signal line OUTB.

Switches SW4 and SW5 are connected in series to both the terminals of the capacitor C1. An interconnection node between the two switches SW4 and SW5 is connected to the common electrode X of the load 20 via an output line OUTC.

FIG. 18 is a diagram showing a schematic configuration of the TERES circuit provided with a power recovery circuit in the circuit shown in FIG. 17. In FIG. 18, constituent elements having the same function as those shown in FIG. 17 are designated by the same numerals and symbols, and a duplicate explanation is omitted.

In FIG. 18, a power recovery circuit 21 is connected to the interconnection node between the switches SW4 and SW5, and connected to the common electrode X of the load 20 via the output line OUTC. The power recovery circuit 21 includes two coils L1 and L2 which are connected to the load 20, a switch SW6 connected in series to the coil L1, and a switch SW7 connected in series to the coil L2. The power recovery circuit 21 further includes a capacitor C2 connected between an interconnection node of the two switches SW6 and SW7 and the second signal line OUTB.

The load 20 and the coils L1 and L2 which are connected to the load 20 constitute two serial resonant circuits. In other words, the power recovery circuit 21 has two L-C resonant circuits and recovers electric charge, which was supplied to a panel by resonance between the coil L1 and the load 20, by resonance between the coil L2 and the load 20.

The switches SW1 to SW7 are controlled by the control signals respectively supplied from the control circuit 5 shown in FIG. 15. The control circuit 5 is configured using a logic circuit and the like, and it generates the control signals based on the display data D, the clock CLK, the horizontal synchronization signal HS, the vertical synchronization signal VS, and the like which are supplied from the outside, and supplies these control signals to the switches SW1 to SW7.

FIG. 19 is a time chart showing driving waveforms of a driving circuit of the AC-driven PDP device configured as shown in FIG. 18 during a sustain discharge period. Note that the sustain discharge period is a period in which in order to allow a cell associated with the display data D to emit light and carry out a display operation, electric discharge is performed between the common electrode X and the scan electrode Y in the cell.

In the sustain discharge period, on the common electrode X side, first, the switches SW1, SW3, and SW5 are turned on, and the remaining switches SW2, SW4, SW6, and SW7 are turned off. At this time, a voltage (a first potential) of the first signal line OUTA becomes (+Vs/2), while a voltage (a second potential) of the second signal line OUTB and a voltage of the output line OUTC become a ground level (point in time t1).

Then, by turning on the switch SW6 in the power recovery circuit 21, L-C resonance occurs between the coil L1 and the capacitance of the load 20, and the electric charge recovered in the capacitor C2 is supplied to the load 20 via the switch SW6 and the coil L1 (point in time t2). This current flow causes the voltage of the output line OUTC applied to the common electrode X to increase gradually as shown by a period between points in time t2 and t3. Further, at the point in time t2, the switch SW5 is turned off.

Subsequently, by turning on the switch SW4 in the neighborhood of a peak voltage generated during this resonance (more specifically, just before the voltage reaches the voltage (+Vs/2) after increasing from the ground level), the voltage of the output line OUTC applied to the common electrode X is clamped to (Vs/2) (point in time t3). Further, at the point in time t3, the switch SW6 is turned off.

When the voltage of the output line OUTC applied to the common electrode X is changed from (Vs/2) to the ground level (0 V), first the switch SW7 is turned on, and then the switch SW4 is turned off (point in time t4). As a result, L-C resonance occurs between the coil L2 and the capacitance of the load 20, and part of the electric charge stored in the load 20 is recovered into the capacitor C2 in the power recovery circuit 21. This current flow causes the voltage of the output line OUTC applied to the common electrode X to decrease gradually as shown by a period between points in time t4 and t5.

Then, by turning on the switch SW5 in the neighborhood of a peak voltage (a peak in a minus direction) generated during this resonance, the voltage of the output line OUTC applied to the common electrode X is clamped to the ground level (point in time t5). Also, at the point in time t5, the switch SW7 is turned off.

Next, the switches SW1, SW3, and SW5 are turned off, and the switches SW2 and SW4 are turned on. The switches SW6 and SW7 remain off. Accordingly, the voltages of the first signal line OUTA and the output line OUTC become the ground level, and the voltage of the second signal line OUTB becomes (−Vs/2) (point in time t6).

Then, by turning on the switch SW7 in the power recovery circuit 21, L-C resonance occurs between the coil L2 and the capacitance of the load 20, and the electric charge (minus side) recovered in the capacitor C2 is supplied to the load 20 via the switch SW7 and the coil L2. This current flow causes the voltage of the output line OUTC applied to the common electrode X to decrease gradually as shown by a period between points in time t7 and t8. Moreover, at the point in time t7, the switch SW4 is turned off.

Thereafter, by turning on the switch SW5 in the neighborhood of a peak voltage (a peak in the minus direction) generated during this resonance (more specifically, just before the voltage reaches the voltage (−Vs/2) after decreasing from the ground level), the voltage of the output line OUTC applied to the common electrode X is clamped to (−Vs/2) (point in time t8). Further, at the point in time t8, the switch SW7 is turned off.

When the voltage of the output line OUTC applied to the common electrode X is changed from (−Vs/2) to the ground level (0 V), first, the switch SW6 is turned on, and then the switch SW5 is turned off (point in time t9). As a result, L-C resonance occurs between the coil L1 and the capacitance of the load 20, and part of the electric charge stored in the load 20 is recovered into the capacitor C2 in the power recovery circuit 21. This current flow causes the voltage of the output line OUTC applied to the common electrode X to increase gradually as shown by a period between points in time t9 and t10.

Then, by turning on the switch SW4 in the neighborhood of a peak voltage generated during this resonance, the voltage of the output line OUTC applied to the common electrode X is clamped to the ground level (point in time t10). Also, at the point in time t10, the switch SW6 is turned off.

The driving circuit (TERES circuit) shown in FIG. 18 applies a voltage which changes from (−Vs/2) to (Vs/2) to the common electrode X during the sustain discharge period. Further, it applies voltages (+Vs/2, −Vs/2) each having a polarity opposite to the voltage supplied to the common electrode X are alternately applied to the scan electrode Y on each display line. Thus, the AC-driven PDP device 1 can perform sustain discharge.

Incidentally, during the sustain discharge period, wall charges having opposite polarities needed for sustain discharge are stored in protective film surfaces on the common electrode X and the scan electrode Y. When the discharge is performed between the common electrode X and the scan electrode Y, the wall charges on the common electrode X and the scan electrode Y in the cell respectively become wall charges having polarities opposite to those up to this time to thereby complete the discharge. On this occasion, time for the wall charges to move is needed, and this time is determined by a period of time when the voltage (+Vs/2) or the voltage (−Vs/2) is applied to the common electrode X.

SUMMARY OF THE INVENTION

A driving circuit of the present invention comprises a first signal line and a second signal line respectively supplying a first potential and a second potential to one end of a capacitive load, a waveform output circuit, and a reactive current preventing switch. An input terminal of the waveform output circuit is connected to a supply line supplying a third potential, an output terminal thereof is connected to the first signal line or the second signal line, and a control terminal thereof is connected to a waveform generating circuit. The reactive current preventing switch is connected between the control terminal and the output terminal or the input terminal of the waveform output circuit.

According to the present invention, for example, when the waveform output circuit is configured using an npn transistor, the reactive current preventing switch is connected between the control terminal and the output terminal of the waveform output circuit, and during a period when the reactive current is prevented from flowing, the reactive current preventing switch is bought into conduction to make a potential difference between the control terminal and the output terminal of the waveform output circuit smaller, so that it becomes impossible to operate the waveform output circuit.

Moreover, for example, when the waveform output circuit is configured using a pnp transistor, the reactive current preventing switch is connected between the control terminal and the input terminal of the waveform output circuit, and during a period when the reactive current is prevented from flowing, the reactive current preventing switch is bought into conduction to make a potential difference between the control terminal and the input terminal of the waveform output circuit smaller, so that it becomes impossible to operate the waveform output circuit.

DETAILED DESCRIPTION OF THE PREFERRED EMBODIMENTS

Figure 18:
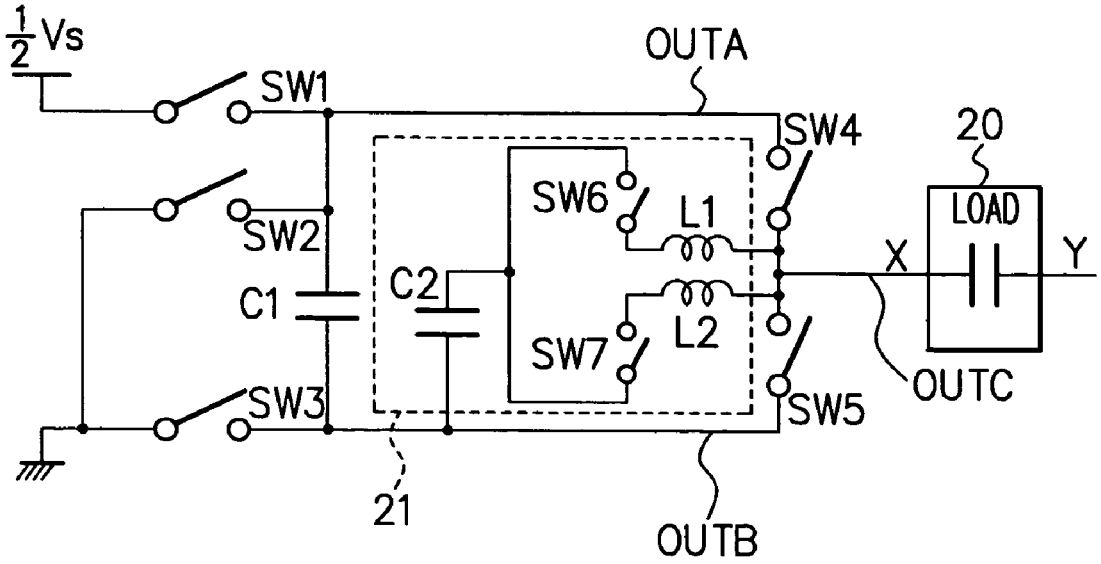
FIG. 18 PRIOR ART
FIG. 18 is a diagram showing a schematic configuration of the TERES circuit including a power recovery circuit.
Figure 19:
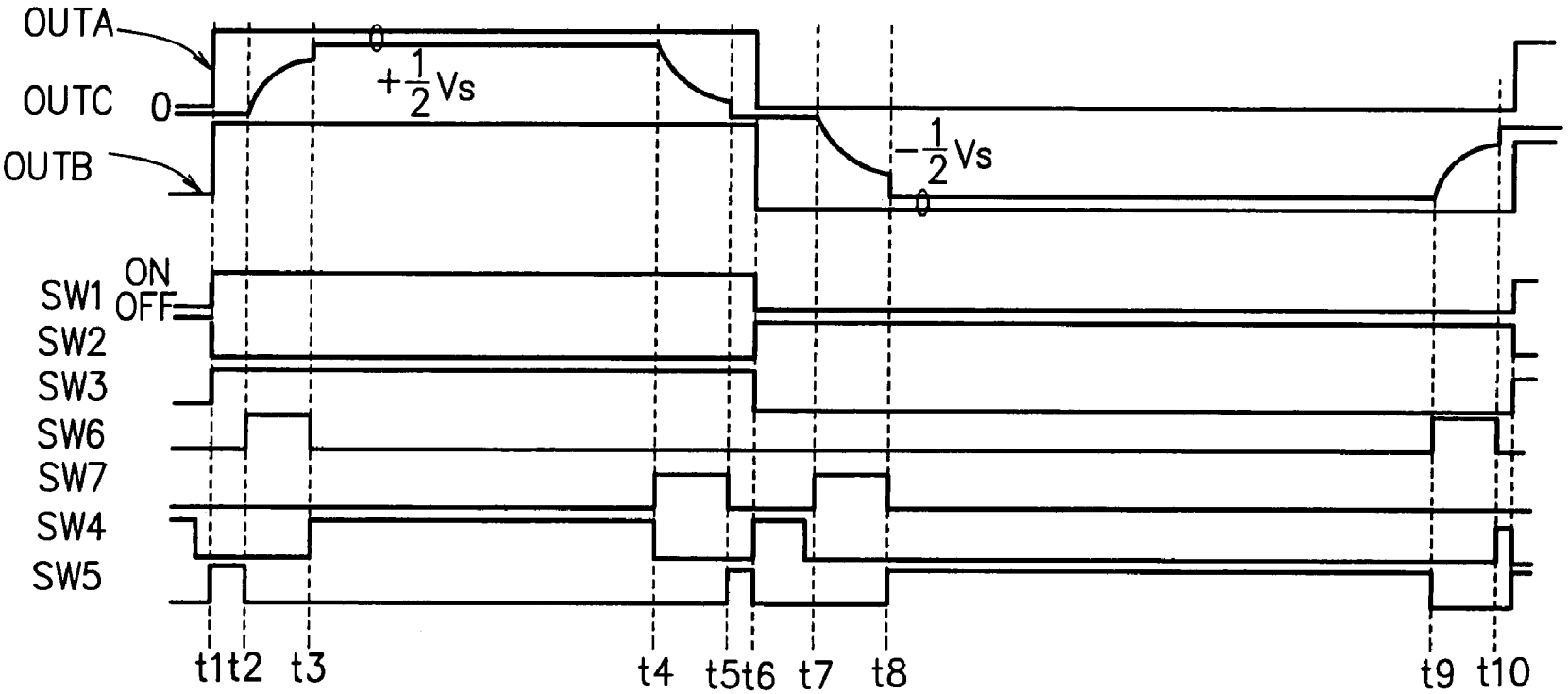
FIG. 19 PRIOR ART
FIG. 19 is a diagram showing driving waveforms of the driving circuit shown in FIG. 18 during a sustain discharge period.

A driving circuit shown in FIG. 18 has many switches and its control timing of each of the switches is complicated. Hence, a driving circuit such as shown in FIG. 20 which realizes a reduction in the number of circuit elements including switches, a capacitor C2 for power recovery, and a voltage monitoring circuit for the capacitor C2 is proposed.

Figure 17:
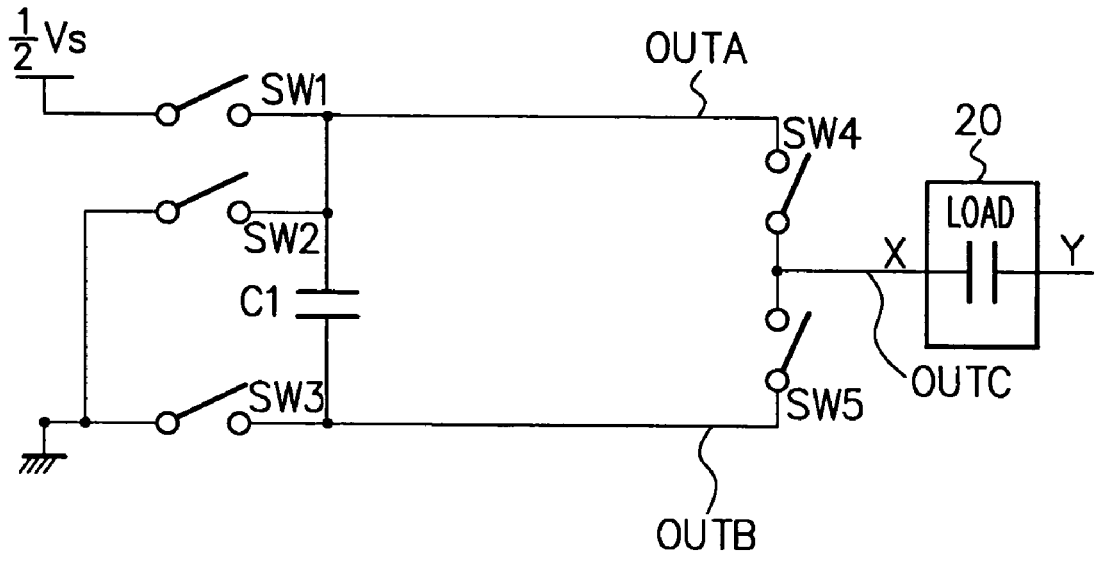
F I G. 17 PRIOR ART
FIG. 17 is a diagram showing a schematic configuration of a TERES circuit.
Figure 20:
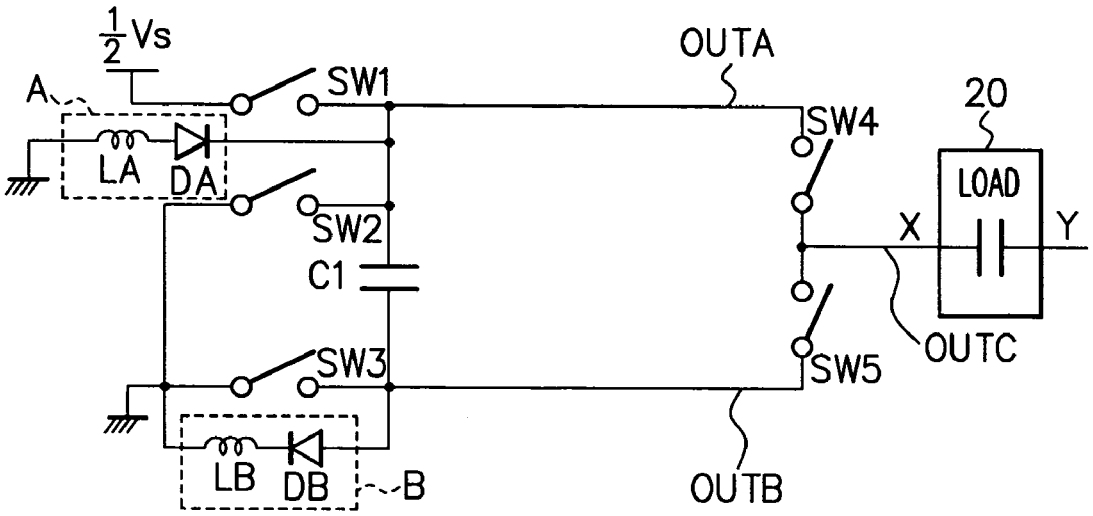
FIG. 20 is a diagram showing another schematic configuration of the TERES circuit including the power recovery circuit.

FIG. 20 is a diagram showing a schematic configuration of a driving circuit (TERES circuit) having a power recovery function although the number of circuit elements is reduced. In FIG. 20, constituent elements having the same functions as those shown in FIG. 17 are designated by the same numerals and symbols, and a duplicate explanation is omitted.

In FIG. 20, a coil circuit A is connected between an interconnection node of two switches SW1 and SW2 and a ground, and a coil circuit B is connected between an interconnection node of a capacitor C1 and a switch SW3 and the ground. In other words, the coil circuit A is connected between a first signal line OUTA and the ground, and the coil circuit B is connected between a second signal line OUTB and the ground.

The coil circuit A includes a diode DA and a coil LA. A cathode terminal of the diode DA is connected to the interconnection node between the switches SW1 and SW2, and an anode terminal thereof is connected to the ground via the coil LA. The coil circuit B includes a diode DB and a coil LB. A cathode terminal of the diode DB is connected to the ground via the coil LB, and an anode terminal thereof is connected to the interconnection node between the capacitor C1 and the switch SW3.

The coils LA and LB are configured to generate L-C resonance with a load 20 via switches SW4 and SW5. As shown by forward directions of the diodes DA and DB, the coil circuit A is a charging circuit to supply electric charge to the load 20 via the switch SW4, whereas the coil circuit B is a discharge circuit to discharge electric charge from the load 20 via the switch SW5. By appropriately controlling the timing between charge processing of the charging circuit composed of the coil circuit A, the switch SW4, and the load 20 and discharge processing of the discharge circuit composed of the coil circuit B, the switch SW5, and the load 20, the same power recovery function for the load 20 as that of a current recovery circuit 21 shown in FIG. 18 can be realized.

Figure 21:
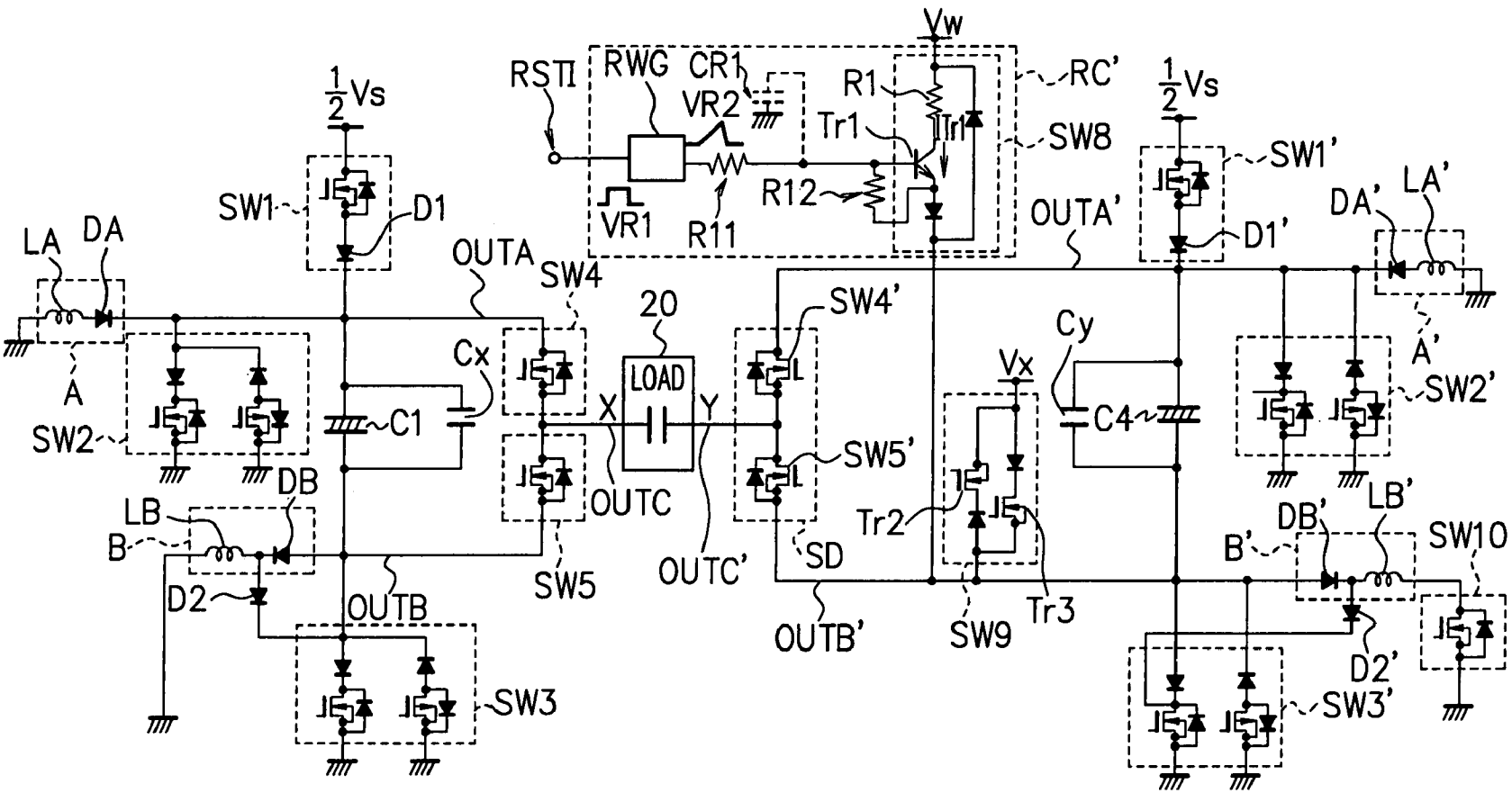
FIG. 21 is a diagram showing a driving circuit in an AC-driven PDP device to which the circuit shown in FIG. 20 is applied.

FIG. 21 is a diagram showing a concrete circuit configuration of a driving circuit (containing the scan electrode Y side) in an AC-driven PDP device to which the circuit shown in FIG. 20 is applied.

In FIG. 21, the load 20 is the total capacitance of cells formed between one common electrode X and one scan electrode Y. The common electrode X and the scan electrode Y are formed in the load 20. The scan electrode Y here is any scan electrode out of scan electrodes Y1 to Yn shown in FIG. 15.

Switches SW1 to SW5, a capacitor C1, and coil circuits A and B on the common electrode X side respectively correspond to the switches SW1 to SW5, the capacitor C1, and the coil circuits A and B shown in FIG. 20. A first signal line OUTA and a second signal line OUTB respectively correspond to the first signal line OUTA and the second signal line OUTB shown in FIG. 20. The common electrode X side further includes a capacitor Cx connected in parallel with the capacitor C1 and a diode D2 whose anode terminal is connected to the cathode terminal of the diode DB and whose cathode terminal is connected to the interconnection node between the capacitor C1 and the switch SW3.

On the other hand, switches SW1' to SW5', capacitors C4 and Cy, coil circuits A' and B', a third signal line OUTA' and a fourth signal line OUTB' on the scan electrode Y side respectively correspond to the switches SW1 to SW5, the capacitors C1 and Cx, the coil circuit A and B, the first signal line OUTA, and the second signal line OUTB on the common electrode X side, and they are connected in the same manner as those on the common electrode X side. On the scan electrode Y side, however, the fourth signal line OUTB' is connected to the ground via the coil circuit B' and a switch SW10. Incidentally, the switches SW4' and SW5' constitute a scan driver SD which outputs a scan pulse at the time of scanning during an address period when a display cell is selected based on display data D and performs a line-by-line selection operation of the scan electrode Y.

Moreover, on the scan electrode Y side, a reset circuit RC' including a switch SW8 and a reset waveform generating circuit RWG is connected between the fourth signal line OUTB' and a power supply line which generates a write voltage Vw to initialize (reset) all cells by performing electric discharge in all the cells on all display lines. The switch SW8 includes a resistance R1 and an npn transistor Tr1.

The reset waveform generating circuit RWG generates and outputs a ramp wave VR2 whose signal level (for example, voltage, current, or the like) changes with the passage of time from a reset signal VR1 inputted from a reset signal input terminal RSTI. An input terminal of the reset waveform generating circuit RWG is connected to the reset signal input terminal RSTI, and an output terminal thereof is connected to a base terminal of the npn transistor Tr1 via a resistance R11.

A collector terminal of the npn transistor Tr1 is connected to the power supply line which generates the write voltage Vw via the resistance R1, and an emitter terminal thereof is connected to the fourth signal line OUTB' via a diode. A resistance R12 is connected between the base terminal and the emitter terminal of the npn transistor Tr1. CR1 in the reset circuit RC' is a stray capacitance between the base terminal of the npn transistor Tr1 and the ground.

A switch SW9 including n-channel type MOS (metal-oxide semiconductor) transistors Tr2 and Tr3 is connected between the fourth signal line OUTB' and the power supply line generating the voltage Vx.

In the driving circuit shown in FIG. 21, the reset circuit RC' is provided to supply a reset pulse for performing a write to all the cells during a reset period of one sub-field which is divided into a reset period, an address period, and a sustain discharge period. Accordingly, the npn transistor Tr1 in the reset circuit RC' needs to operate so as to be on only during the reset period and off during the other periods.

In the driving circuit shown in FIG. 21, however, there is a possibility that the npn transistor Tr1 becomes on in periods other than the reset period. An explanation will be given below with reference to FIG. 22.

Figure 22:
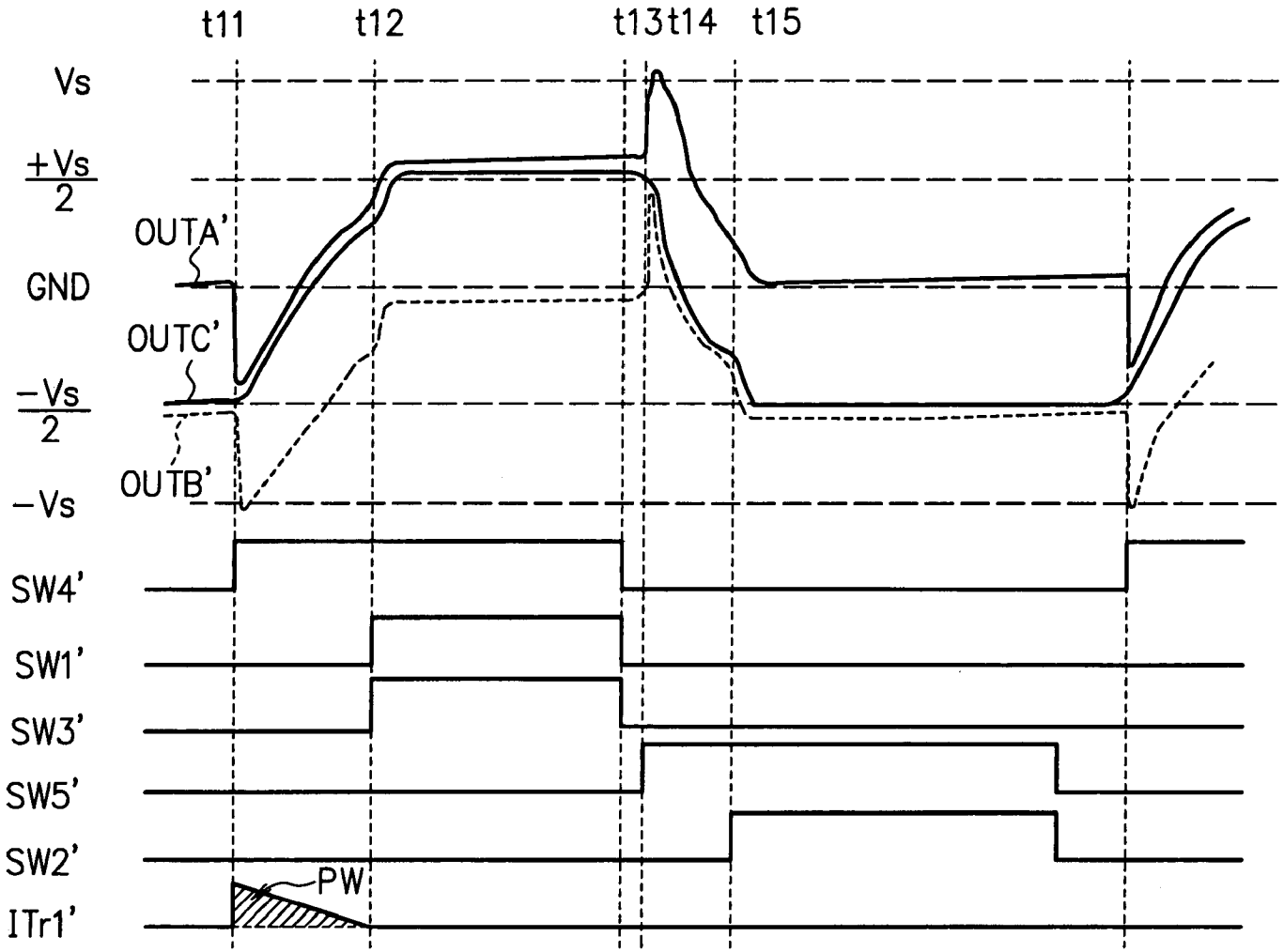
FIG. 22 is a diagram showing driving waveforms of the driving circuit shown in FIG. 21 during the sustain discharge period.

FIG. 22 is a diagram showing driving waveforms of the driving circuit shown in FIG. 21 during the sustain discharge period.

FIG. 22 shows driving waveforms on the scan electrode Y side, and voltage waveforms of the third signal line OUTA' and the fourth signal line OUTB' are shown together with that of an output line OUTC'. Here, vertical axes of these voltage waveforms coincide with a voltage value of the output line OUTC', and in order that they can be easily seen, a graphic representation is given with the voltage waveform of the third signal line OUTA' being raised a little and the voltage waveform of the fourth signal line OUTB' being lowered a little.

First, when the switch SW4' is turned on in a state where the third signal line OUTA' is the ground, the fourth signal line OUTB' and the output line OUTC' are (−Vs/2) and the switches SW1' to SW5' are off, the voltage (−Vs/2) stored in the load 20 is transmitted to the third signal line OUTA' via the switch SW4'. Thereby, the voltage of the third signal line OUTA' becomes (−Vs/2), and this voltage is applied to one terminal of the capacitor C4. As a result, the potential of the other terminal of the capacitor C4 changes to (−Vs), and thereby the voltage of the fourth signal line OUTB' changes to (−Vs) (point in time t11).

Then, immediately after the point in time t11, L-C resonance is initiated between the coil LA' and the capacitance of the load 20 via the switch SW4', and thereby electric charge is supplied from the ground to the load 20 via the coil LA' and the switch SW4'. Consequently, the potentials of the third signal line OUTA' and the output line OUTC' increase from (−Vs/2) to around (+Vs/2) via a ground level potential. This current flow causes the voltage of the output line OUTC' applied to the scan electrode Y to increase gradually as shown by a period between points in time t11 and t12.

Then, by turning on the switches SW1' and SW3' in the neighborhood of a peak voltage generated during this resonance (more specifically, before the voltage (+Vs/2) is reached), the voltage of the output line OUTC' applied to the scan electrode Y is clamped to (+Vs/2) (point in time t12). Thereafter, the switches SW1', SW3', and SW4' are turned off (point in time t13). Then, the switch SW5' is turned on (point in time t14). Thereby, the voltage (Vs/2) stored in the load 20 is applied to the fourth signal line OUTB' via the switch SW5', and the voltage of the fourth signal line OUTB' becomes (Vs/2). As a result, the voltage of the third signal line OUTA' increases to Vs.

Then, immediately after a point in time t14, L-C resonance is initiated between the coil LB' and the capacitance of the load 2*b* via the switch SW5', and thereby electric charge is discharged from the load 20 to the ground via the switch SW5' and the coil LB'. Consequently, the potentials of the fourth signal line OUTB' and the output line OUTC' decrease from (+Vs/2) to around (−Vs/2) via the ground level potential. This current flow causes the voltage of the output line OUTC' applied to the scan electrode Y to decrease gradually as shown by a period between points in time t14 and t15.

Then, by turning on the switches SW2' in the neighborhood of a peak voltage generated during this resonance (more specifically, before the voltage (−Vs/2) is reached), the voltage of the output line OUTC' applied to the scan electrode Y is clamped to (−Vs/2) (point in time t15). By the operation explained above, the driving circuit shown in FIG. 21 applies the voltage which changes from (−Vs/2) to (+Vs/2) to the scan electrode Y during the sustain discharge period. Moreover, by alternately applying voltages (+Vs/2, −Vs/2) each having a polarity opposite to the voltage applied to the scan electrode Y to the common electrode X, sustain discharge is performed in the AC-driven PDP device.

During the period between the points in time t11 and t12, in which a current flows through the coil LA', shown in FIG. 22, a sharp negative voltage such as shown in FIG. 22 is applied to the emitter terminal of the transistor Tr1 connected to the fourth signal line OUTB', and thereby the potential of the emitter terminal becomes lower than that of the base terminal. If electric charge stored in the stray capacitance CR1 between the base terminal of the transistor Tr1 and the ground flows as a base current via a base-emitter junction at this time, the transistor Tr1 is brought into conduction, and hence a current PW such as shown by ITr1' in FIG. 22 flows from the reset circuit RC'. The current PW which flows during the period between the points in time t11 and t12 becomes a reactive current and causes an increase in power consumption in the transistor Tr1. Further, there is a possibility that heat generation due to the reactive current flowing through the transistor Tr1 causes element destruction and the like, which may trigger a reduction in reliability.

An object of the present invention is to prevent the aforementioned reactive current from flowing and to improve the reliabilities of a driving circuit and a plasma display device using the driving circuit.

Embodiments of the present invention will described below based on the drawings.

Figure 15:
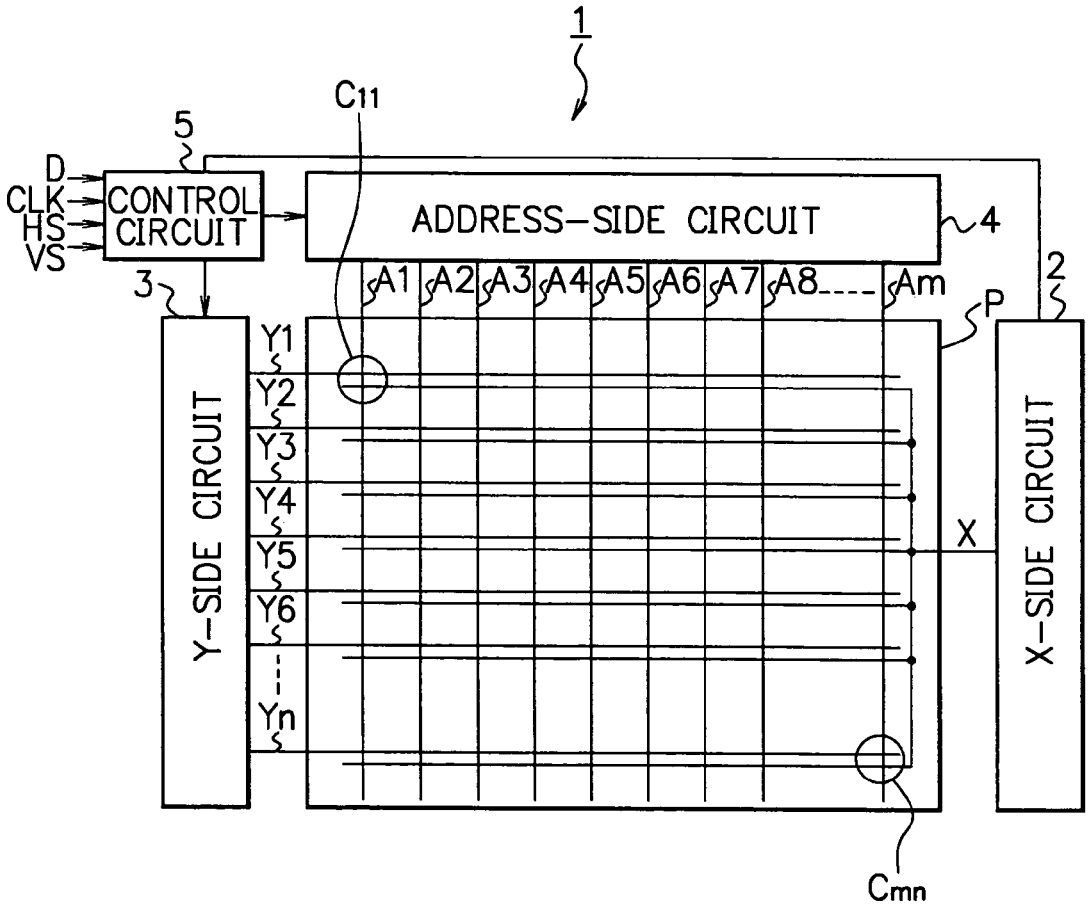
F I G. 15 PRIOR ART
FIG. 15 is a diagram showing an overall configuration of an AC-driven PDP device.
Figure 16A:
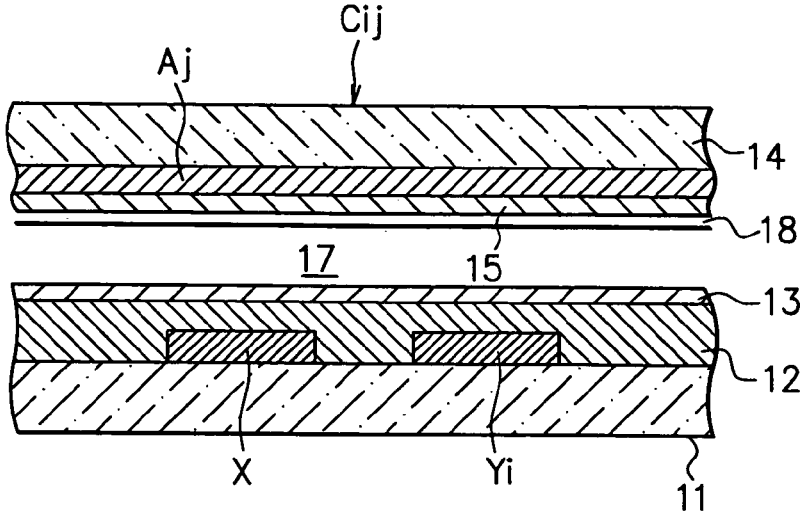
FIG. 16A PRIOR ART
FIG. 16A to FIG. 16C are diagrams each showing a cross sectional structure of a cell Cij at an i-th row and a j-th column as one pixel in the AC-driven PDP device.
Figure 16B:
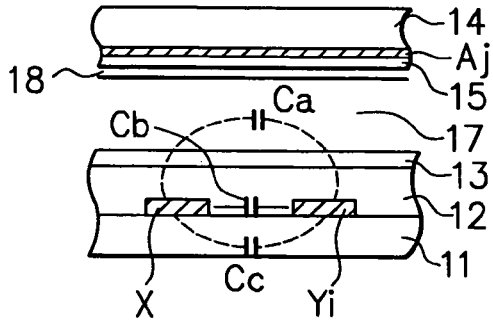
FIG. 16B PRIOR ART
Figure 16C:
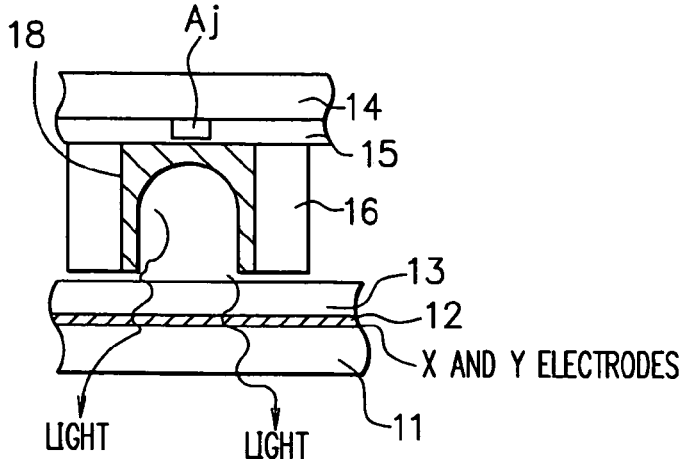
FIG. 16C PRIOR ART

A driving circuit in each of the embodiments of the present invention is applicable to a matrix type flat panel display device using a capacitive load, for example, an AC-driven PDP device 1 whose overall configuration is shown in FIG. 15 and whose cell structure is explained in FIG. 16A to FIG. 16C. Hereinafter, as an example, a case where the driving circuit is applied to the plasma display device shown in FIG. 15 and FIG. 16A to FIG. 16C will be explained.

First, the principle of a driving circuit according to each of the embodiments of the present invention will be explained with reference to FIG. 1 to FIG. 3.

Figure 1:
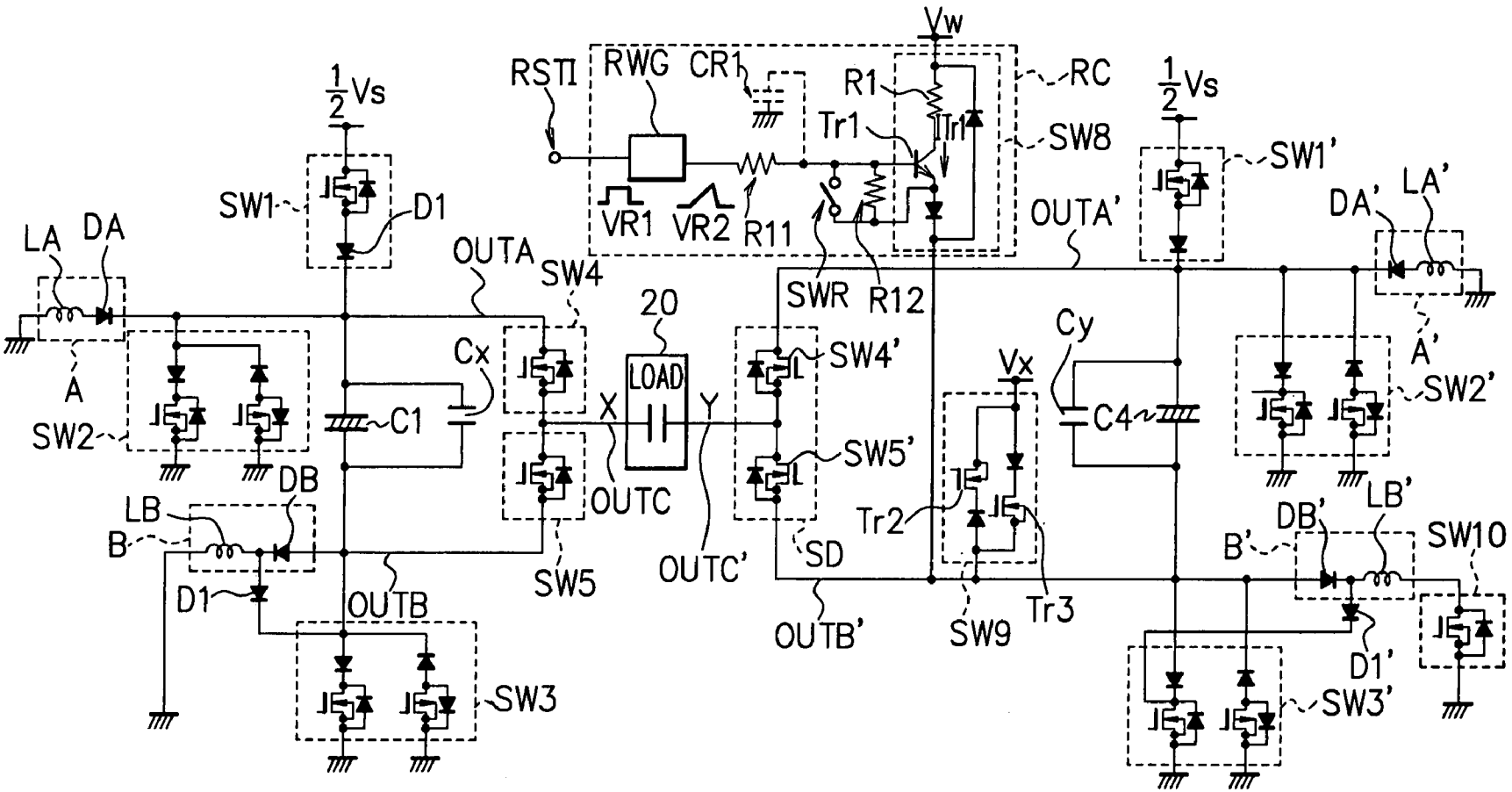
FIG. 1 is a diagram for explaining the principle of a driving circuit according to each of embodiments of the present invention.

FIG. 1 is a circuit diagram for explaining the principle of the driving circuit according to each of the embodiments of the present invention.

In FIG. 1, a load 20 is the total capacitance of cells formed between one common electrode X and one scan electrode Y. The common electrode X and the scan electrode Y are formed in the load 20. The scan electrode Y here is any scan electrode out of scan electrodes Y1 to Yn shown in FIG. 15.

On the common electrode X side, switches SW1 and SW2 are connected in series between a power supply line with a voltage (Vs/2) supplied from a power supply not shown and a ground. One terminal of a capacitor C1 is connected to an interconnection node of the two switches SW1 and SW2, and a switch SW3 is connected between the other terminal of the capacitor C1 and the ground. A capacitor Cx is connected in parallel with the capacitor C1.

Switches SW4 and SW5 which are connected in series are connected to both the terminals of the capacitor C1. An interconnection node of the two switches SW4 and SW5 is connected to the common electrode X of the load 20 via an output line OUTC.

A coil circuit A includes a diode DA and a coil LA, and a coil circuit B includes a diode DB and a coil LB. A cathode terminal of the diode DA is connected to an interconnection node between the switches SW1 and SW2, and an anode terminal thereof is connected to the ground via the coil LA. A cathode terminal of the diode DB is connected to the ground via the coil LB, and an anode terminal thereof is connected to an interconnection node between the capacitor C1 and the switch SW3.

An anode terminal of a diode D1 is connected to the cathode terminal of the diode DB, and a cathode terminal thereof is connected to the interconnection node between the capacitor C1 and the switch SW3.

On the other hand, on the scan electrode Y side, switches SW1' and SW2' are connected in series between a power supply line with the voltage (Vs/2) supplied from the power supply not shown and the ground. One terminal of a capacitor C4 is connected to an interconnection node of the two switches SW1' and SW2', and a switch SW3' is connected between the other terminal of the capacitor C4 and the ground. A capacitor Cy is connected in parallel with the capacitor C4.

Switches SW4' and SW5' which are connected in series are connected to both the terminals of the capacitor C4. An interconnection node of the two switches SW4' and SW5' is connected to the scan electrode Y of the load 20 via an output line OUTC'. The switches SW4' and SW5' constitute a scan driver SD. The scan driver SD outputs a scan pulse at the time of scanning during an address period to perform a line-by-line selection operation of the scan electrode Y. A connection line which connects the switch SW4' and one terminal of the capacitor C4 is referred to as a third signal line OUTA', and a connection line which connects the switch SW5' and the other terminal of the capacitor C4 is referred to as a fourth signal line OUTB'.

A coil circuit A' includes a diode DA' and a coil LA', and a coil circuit B' includes a diode DB' and a coil LB'. A cathode terminal of the diode DA' is connected to the interconnection node between the switches SW1' and SW2', and an anode terminal thereof is connected to the ground via the coil LA'. A cathode terminal of the diode DB' is connected to the ground via the coil LB' and a switch SW10, and an anode terminal thereof is connected to the interconnection node between the capacitor C4 and the switch SW3'. The switch SW10 is a switch to prevent voltages (Vs/2+Vw) and (Vs/2+Vx) applied to the fourth signal line OUTB' from flowing into the ground during the reset period and the address period.

An anode terminal of a diode D1' is connected to the cathode terminal of the diode DB', and a cathode terminal thereof is connected to the interconnection node between the capacitor C4 and the switch SW3'.

A reset circuit RC including a reactive current preventing switch SWR, a switch SW8, and a reset waveform generating circuit RWG is connected between the fourth signal line OUTB' and a power supply line which generates a write voltage Vw. The switch SW8 includes a resistance R1 and an npn transistor Tr1.

An input terminal of the reset waveform generating circuit RWG is connected to a reset signal input terminal RSTI and an output terminal thereof is connected to a base terminal of the npn transistor Tr1 via a resistance R11. The reset waveform generating circuit RWG generates and outputs a ramp wave VR2 whose signal level (for example, voltage, current, or the like) changes with the passage of time from a reset signal VR1 inputted from the reset signal input terminal RSTI. The rate of change of the signal level in the ramp wave VR2 may be constant irrespective of the passage of time or may be changed with the passage of time (for example, the ratio of change may be gradually reduced with the passage of time).

A collector terminal of the npn transistor Tr1 is connected to the power supply line which generates the write voltage Vw via the resistance R1, and an emitter terminal thereof is connected to the fourth signal line OUTB' via a diode. CR1 in the reset circuit RC is a stray capacitance between the base terminal of the npn transistor Tr1 and the ground.

The reactive current preventing switch SWR and a resistance R12 are connected in parallel between the base terminal and the emitter terminal of the npn transistor Tr1.

A switch SW9 including n-channel type MOS transistors Tr2 and Tr3 is connected between the fourth signal line OUTB' and a power supply line which generates a voltage Vx.

Note that the switches SW1 to SW5, SW8 to SW10, SW1' to SW5', and transistors Tr1 to Tr3 are controlled, for example, by control signals which are respectively supplied from a control circuit 5 shown in FIG. 15.

Next, the operation of an AC-driven PDP device to which the driving circuit shown in FIG. 1 is applied will be explained.

Figure 2:
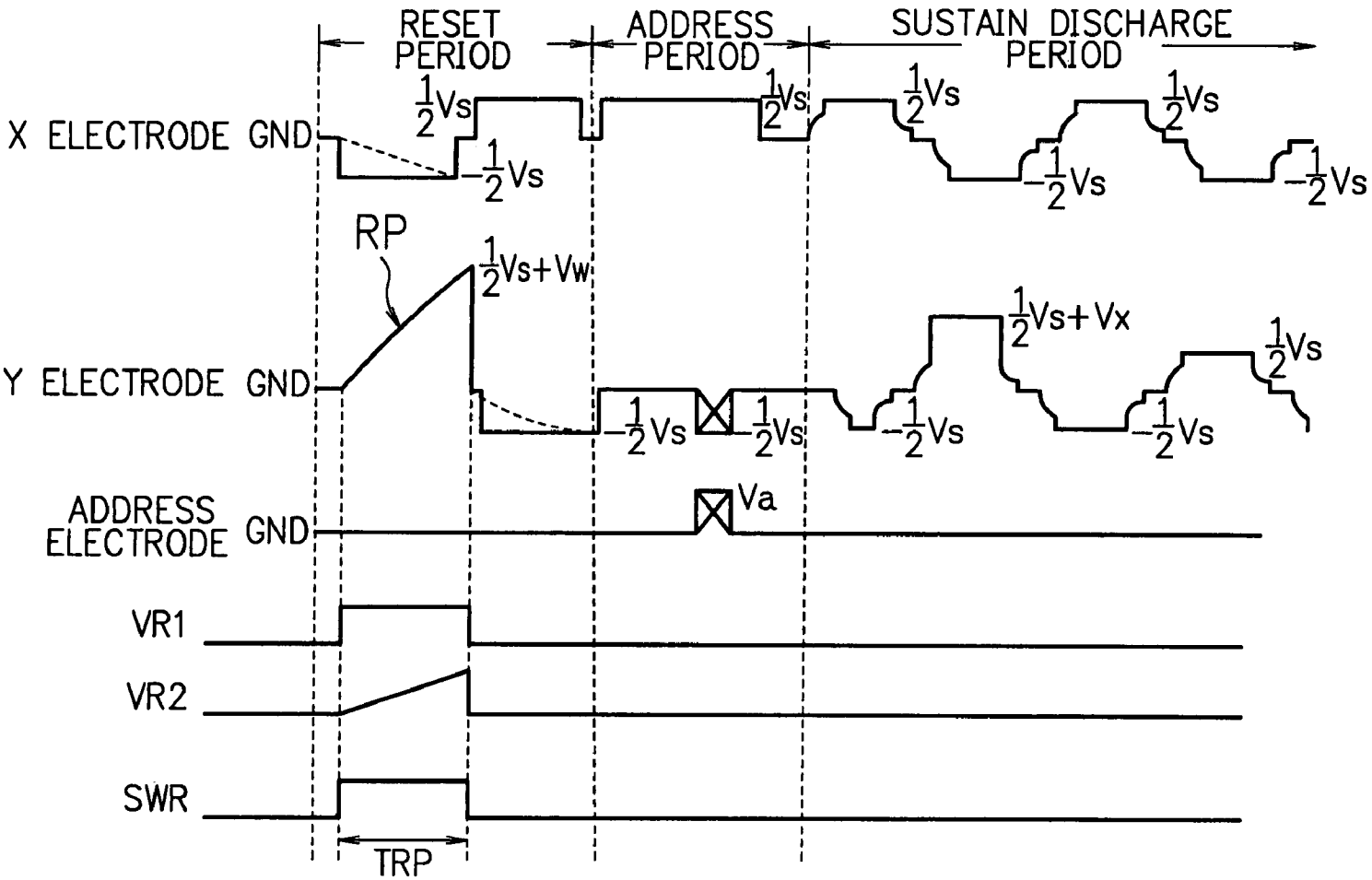
FIG. 2 is a waveform chart showing the operation of an AC-driven PDP device to which the driving circuit shown in FIG. 1 is applied.

FIG. 2 is a waveform chart showing the operation of the AC-driven PDP device to which the driving circuit shown in FIG. 1 is applied. FIG. 2 shows an example of waveforms of voltages applied to the common electrode X, the scan electrode Y, and an address electrode in one sub-field out of plural sub-fields composing one frame. One sub-field is divided into a reset period composed of a total write period and a total erase period, an address period, and a sustain discharge period.

In the reset period, first, the voltage applied to the common electrode X is decreased from the ground level to (−Vs/2).

On the scan electrode Y side, the activated reset signal VR1 is inputted via the reset signal input terminal RSTI, so that the ramp wave VR2 is supplied to the base terminal of the npn transistor Tr1 in the reset circuit RC and simultaneously the reactive current preventing switch SWR is turned off. Consequently, the voltage applied to the scan electrode Y gradually increases with the passage of time, and finally a voltage obtained by adding the write voltage Vw and the voltage (Vs/2) is applied to the scan electrode Y. A signal with this voltage applied to the scan electrode Y and finally reaching (Vs/2+Vw) is referred to as a reset pulse RP, and a period during which the reset pulse RP is supplied is referred to as a reset pulse output period TRP.

Thus, a potential difference between the common electrode X and the scan electrode Y becomes (Vs+Vw), and regardless of a previous display state, electric discharge occurs in all cells on all display lines, and wall charges are formed (total write).

When the reset pulse output period TRP is completed by the reset signal VR1 inputted from the reset signal input terminal RSTI being deactivated, the reactive current preventing switch SWR connected between the base terminal and the emitter terminal of the npn transistor Tr1 in the reset circuit RC is turned on.

Then, after the voltages of the common electrode X and the scan electrode Y are returned to the ground level, the voltage applied to the common electrode X is increased from the ground level to (Vs/2), whereas the voltage applied to the scan electrode Y is decreased to (−Vs/2). Consequently, in all the cells, the voltages of wall charges themselves exceed a discharge inception voltage to thereby start electric discharge, and the stored wall charges are erased (total erase).

Next, during the address period, line-sequential address discharge is performed in order to turn on/off each cell according to display data. At this time, the voltage (Vs/2) is applied to the common electrode X. When applying a voltage to the scan electrode Y corresponding to one display line, a (−Vs/2) level voltage is applied to the line-sequentially selected scan electrode Y, and a ground level voltage is applied to the non-selected scan electrode Y.

At this time, an address pulse with a voltage Va is selectively applied to an address electrode Aj among address electrodes A1 to Am which corresponds to a cell in which sustain discharge occurs, that is, a cell to be lighted. As a result, the discharge occurs between the address electrode Aj of the cell to be lighted and the line-sequentially selected scan electrode Y. This discharge, as priming, immediately shifts to discharge between the common electrode X and the scan electrode Y. As a result, wall charges needed for next sustain discharge are stored in the MgO protective film surfaces above the common electrode X and the scan electrode Y of the selected cell.

Thereafter, during the sustain discharge period, the voltage of the common electrode X gradually increases by the action of the coil circuit A. Then, in the neighborhood of the peak of the increase (before the voltage. (+Vs/2) is reached), the voltage of the common electrode X is clamped to (Vs/2).

Then, the voltage of the scan electrode Y gradually decreases. At this time, part of electric charge is recovered by the coil circuit B'. Then, in the neighborhood of the peak of the decrease (before the voltage (−Vs/2) is reached), the voltage of the scan electrode Y is clamped to (−Vs/2).

Similarly, when the voltages applied to the common electrode X and the scan electrode Y are changed from the voltage (−Vs/2) to the ground level (0V), the applied voltages are gradually increased. In the scan electrode Y, the voltage (Vs/2+Vx) is applied only at the time of the first application of a high voltage. The voltage Vx is a voltage which is added to generate a voltage necessary for sustain discharge by adding the voltage of wall charges generated during the address period.

When the voltages applied to the common electrode X and the scan electrode Y are changed from the voltage (Vs/2) to the ground level, the applied voltages are gradually decreased, and simultaneously part of electric charge stored in the cell is recovered by the coil circuits B and B'.

Thus, during the sustain discharge period, sustain discharge is performed by alternately applying the voltages (+Vs/2, −Vs/2) having opposite polarities to the common electrode X and the scan electrode Y on each display line to thereby display one sub-field of a picture. This operation of alternate application is called a sustain operation.

Figure 3:
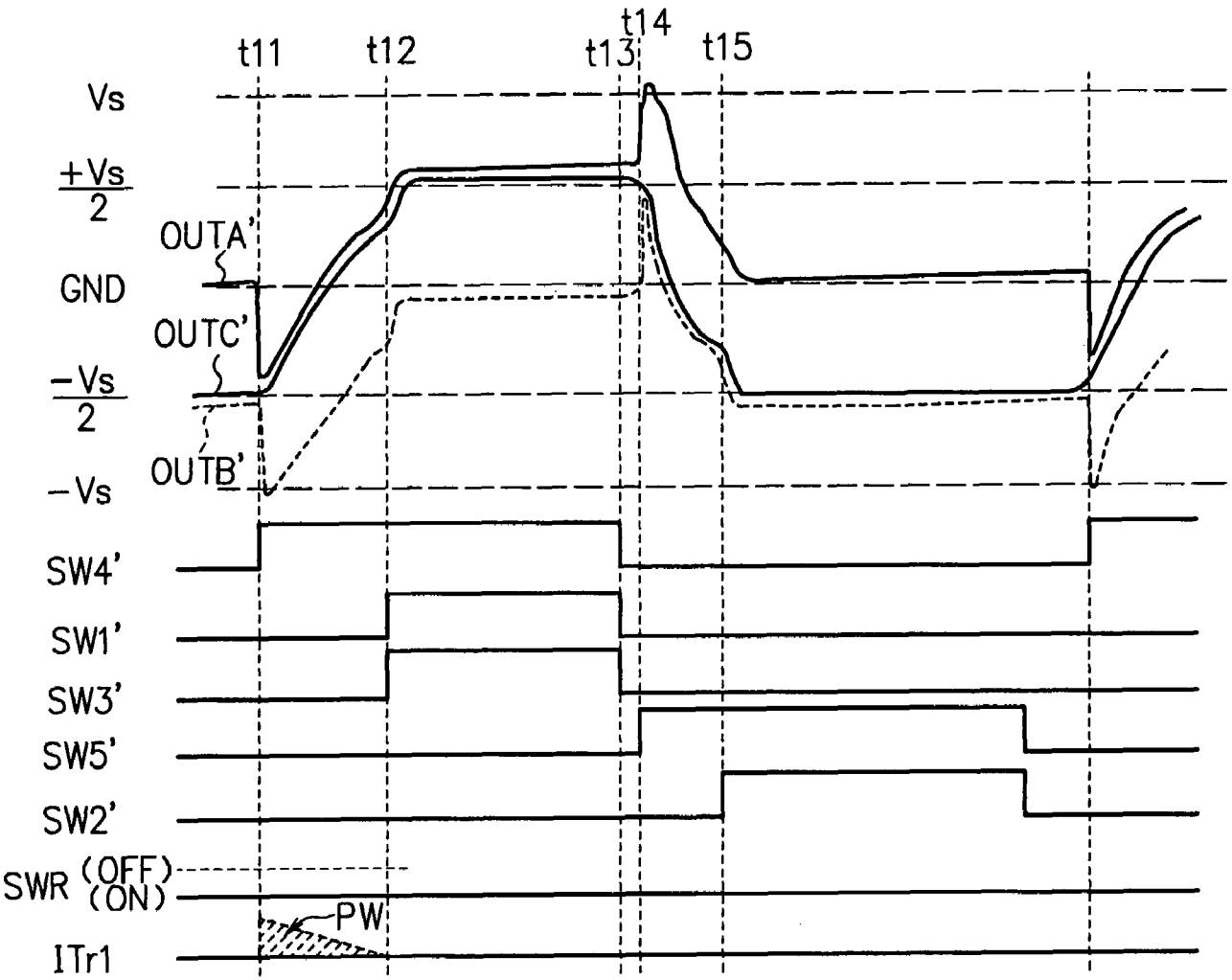
FIG. 3 is a waveform chart showing the operation of the driving circuit shown in FIG. 1 during a sustain discharge period.

FIG. 3 is a time chart showing driving waveforms of the driving circuit shown in FIG. 1 during the sustain discharge period. FIG. 3 shows driving waveforms on the scan electrode Y side, and since other portions, except for the on/off state of the switch SWR and an electric current ITr1 flowing through the npn transistor Tr1, are the same as those in the driving waveforms during the sustain discharge period shown in FIG. 22, the detailed explanation thereof will be omitted.

As shown in FIG. 3, during the sustain discharge period, the reactive current preventing switch SWR in the reset circuit RC in the driving circuit shown in FIG. 1 is always on. Namely, by bringing the reactive current preventing switch SWR connected between the base terminal and the emitter terminal of the transistor Tr1 into conduction, the potential of the base terminal and the potential of the emitter terminal are made equal (or almost equal).

Accordingly, during a period between points in time t11 and t12, in which a current flows through the coil LA', for example, even if the potential of the fourth signal line OUTB' sharply decreases to cause a decrease in the potential of the emitter terminal of the transistor Tr1, the potential of the base terminal decreases in a like manner, whereby the base current does not flow. This can prevent a reactive current from flowing through the transistor Tr1 (Note that in FIG. 3, the reactive current shown in FIG. 22 is shown by a broken line for reference). Hence, an increase in power consumption caused by the reactive current flowing through the transistor Tr1 can be prevented, and heat generation caused by the reactive current can be also prevented, thereby leading to an improvement in the reliability of the driving circuit.

Incidentally, in the above explanation, the reactive current preventing switch SWR is off only during the reset pulse output period TRP and it is on in all other periods except this period. But the reactive current preventing switch SWR is only required to be on during a period when a current flows into at least the coil LA' (for example, the period between the points in time t11 and t12 in FIG. 3), and therefore it may be off during the sustain period. The reactive current preventing switch SWR may be on only during the reset period instead of only during the reset pulse output period TRP.

Concrete configuration examples of the driving circuits according to the embodiments of the present invention will be described below.

It should be mentioned that in a first to a seventh embodiment described below, only the reset circuit RC is represented graphically and explained, and components other than the reset circuit RC can be configured in the same manner as those in the driving circuit shown in FIG. 1.

First Embodiment

Figure 4:
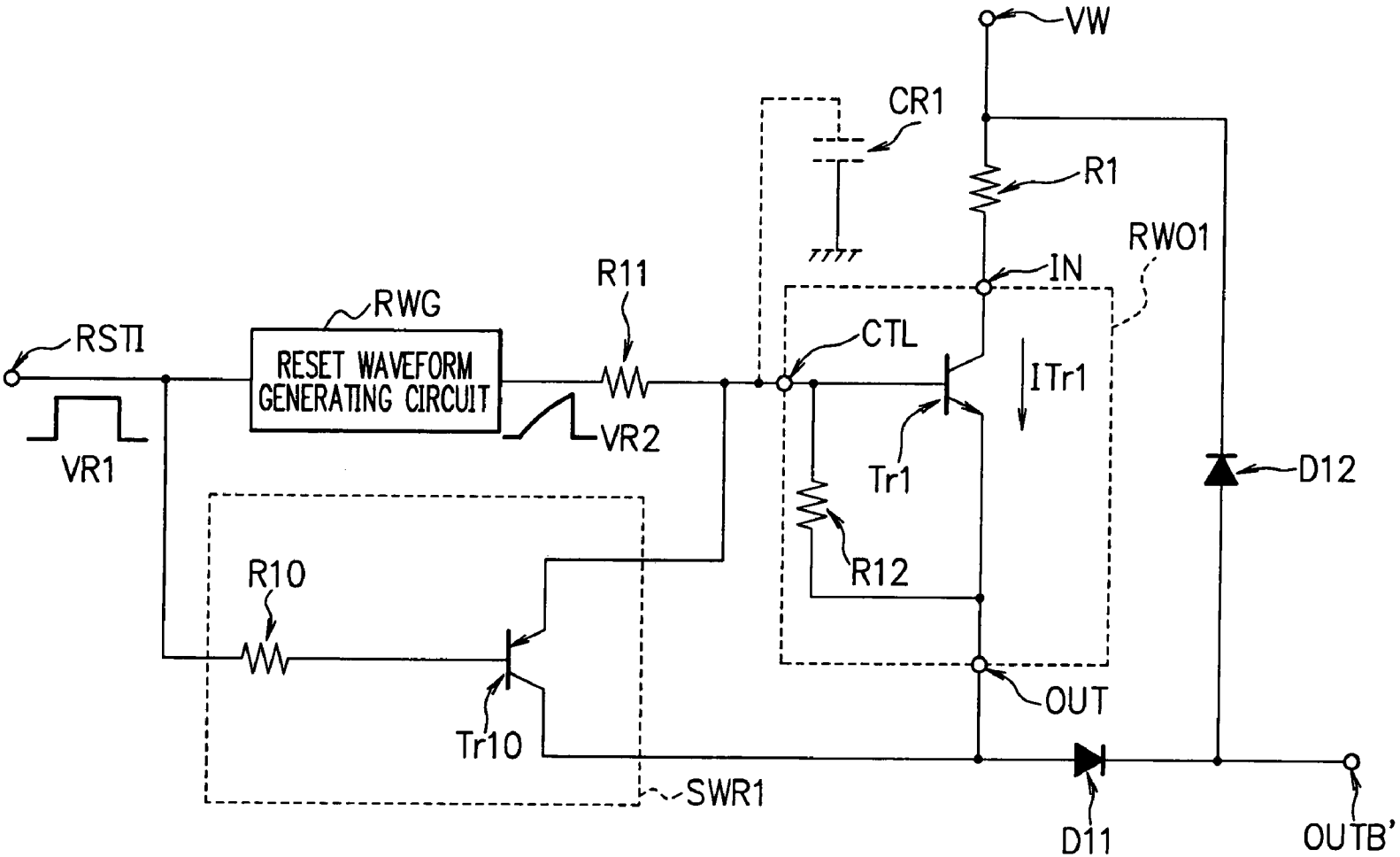
FIG. 4 is a diagram showing a configuration example of a reset circuit of a driving circuit according to a first embodiment.

FIG. 4 is a diagram showing a configuration example of the reset circuit RC of the driving circuit according to the first embodiment. In the reset circuit RC in the first embodiment, as shown in FIG. 4, the reactive current preventing switch SWR is configured using a pnp transistor. In FIG. 4, constituent elements having the same functions as those shown in FIG. 1 are designated by the same numerals and symbols.

In FIG. 4, RWG denotes a reset waveform generating circuit which generates the ramp wave VR2 from the reset signal VR1 and outputs the ramp wave VR2, RWO1 is a reset waveform output circuit which amplifiers and outputs the ramp wave VR2, and SWR1 is a reactive current preventing switch.

An input terminal of the reset waveform generating circuit RWG is connected to the reset signal input terminal RSTI to which the reset signal VR1 is inputted, and an output terminal thereof is connected to a control terminal CTL of the reset waveform output circuit RWO1 via the resistance R11.

The reset waveform output circuit RWO1 includes the control terminal CTL, an input terminal IN connected to the power supply line which generates the write voltage Vw via the resistance R1, and an output terminal OUT connected to an anode terminal of a diode D11 whose cathode terminal is connected to the fourth signal line OUTB'. The reset waveform output circuit RWO1 includes the npn transistor Tr1 to amplify the ramp VR2 and a resistance R12. The transistor Tr1 has a collector terminal connected to the input terminal IN, a base terminal connected to the control terminal CTL, and an emitter terminal connected to the output terminal OUT. The resistance R12 is connected between the base terminal and the emitter terminal of the transistor Tr1.

The reactive current preventing switch SWR1 is composed of a pnp transistor Tr10 and a resistance R10. An emitter terminal of the transistor Tr10 is connected to the control terminal CTL of the reset waveform output circuit RWO1, a base terminal thereof is connected to the reset signal input terminal RSTI via the resistance R10, and a collector terminal thereof is connected to an interconnection node between the output terminal OUT of the reset waveform output circuit RWO1 and the anode terminal of the diode D11.

A diode D12 has an anode terminal connected to the cathode terminal of the diode D11 and a cathode terminal connected to the power supply line which generates the write voltage Vw. CR1 is a stray capacitance between the base terminal of the npn transistor Tr1 and the ground.

The reset circuit in the first embodiment shown in FIG. 4 carries out on/off control of the transistor Tr10 in the reactive current preventing switch SWR1 with the reset signal VR1. More specifically, during the reset pulse output period TRP (period when the reset signal VR1 is activated), the transistor Tr10 is turned off, and during the other periods, the transistor is on. Consequently, during the periods other than the reset pulse output period TRP, the control terminal CTL and the output terminal OUT of the reset waveform output circuit RWO1, that is to say, the base terminal and the emitter terminal of the transistor Tr1 are brought into a conducting state, which can prevent a reactive current from flowing through the transistor Tr1 in a period when a current flows through coil LA', for example, a period between the points in time t11 and t12 shown in FIG. 3. Accordingly, an increase in power consumption caused by the reactive current flowing through the transistor Tr1 can be prevented, and heat generation caused by the reactive current can be also prevented, thereby leading to an improvement in the reliability of the driving circuit.

Second Embodiment

Next, the second embodiment of the present invention will be described.

Figure 5:
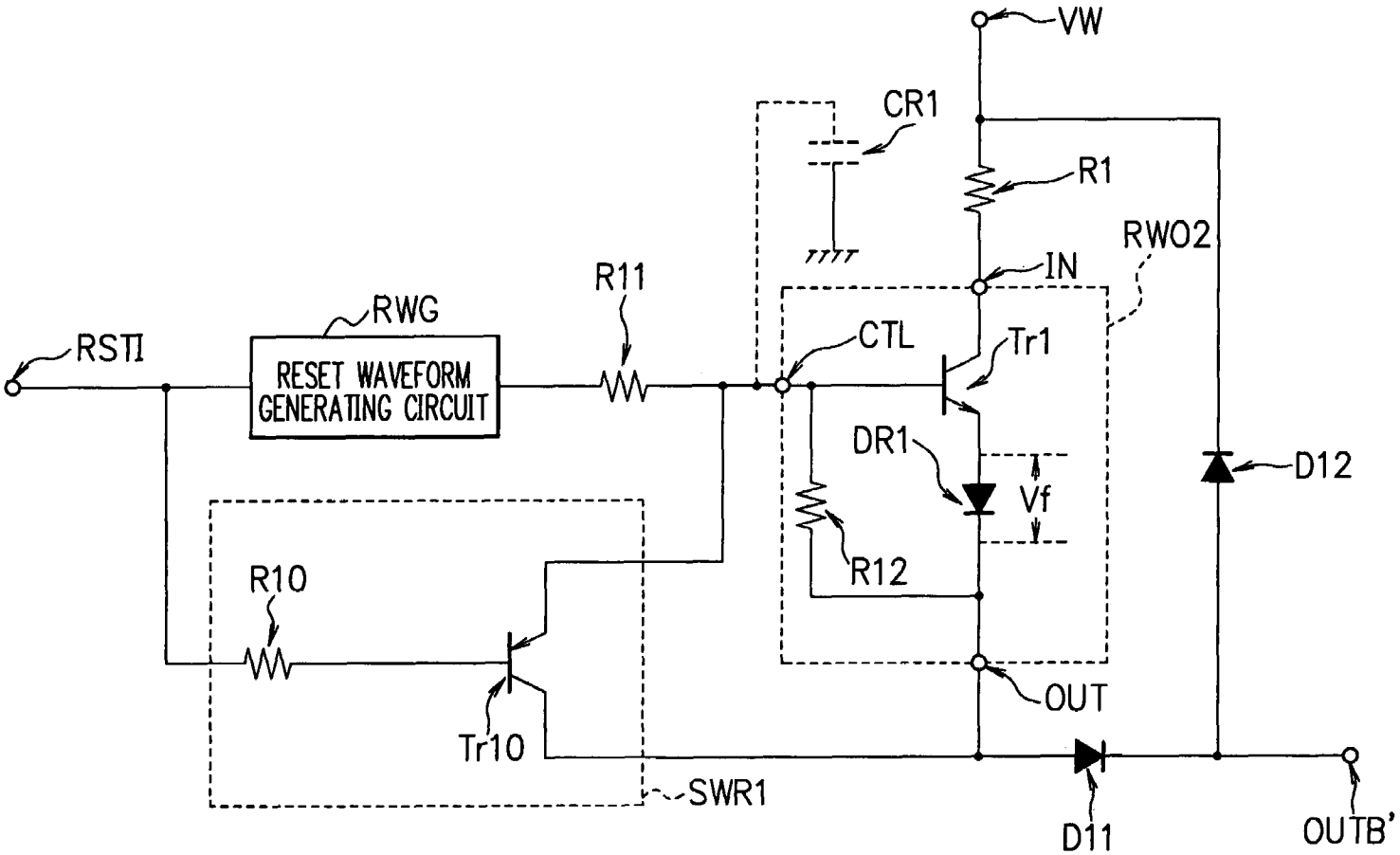
FIG. 5 is a diagram showing a configuration example of a reset circuit of a driving circuit according to a second embodiment.

FIG. 5 is a diagram showing a configuration example of the reset circuit RC of the driving circuit according to the second embodiment. In the reset circuit RC in the second embodiment, a diode DR1 is additionally provided in the reset waveform output circuit RWO1 in the first embodiment. In FIG. 5, constituent elements having the same functions as those shown in FIG. 4 are designated by the same numerals and symbols, and a duplicate explanation is omitted.

In FIG. 5, RWO2 denotes a reset waveform output circuit and includes the npn transistor Tr1, the resistance T12, and the diode DR1. An emitter terminal of the transistor Tr1 is connected to an anode terminal of the diode DR1, and a cathode terminal of the diode DR1 is connected to the output terminal OUT. One end of the resistance R12 is connected to the base terminal of the transistor Tr1 and the other end thereof is connected to the cathode terminal of the diode DR1.

In the reset circuit in the second embodiment shown in FIG. 5, by providing the diode DR1, the voltage needed to turn on the transistor Tr1 (the potential difference between the base terminal and the emitter terminal) can be made higher than that in the reset circuit in the first embodiment by a voltage Vf which corresponds to a forward voltage drop of the diode DR1. As a result, it is possible to increase a margin against noise and the like and prevent the reactive current from flowing. Moreover, the forward voltage drop Vf increases with an increase in forward current to the diode DR1, and therefore even if the reactive current flows through the transistor Tr1 to thereby increase a current, it is possible to prevent the reactive current from flowing by performing a negative feedback operation such as makes it more difficult for the reactive current to flow. Accordingly, an increase in power consumption caused by the reactive current flowing through the transistor Tr1 can be prevented, and heat generation caused by the reactive current can be also prevented, thereby leading to an improvement in the reliability of the driving circuit.

Third Embodiment

Next, the third embodiment of the present invention will be described.

Figure 6:
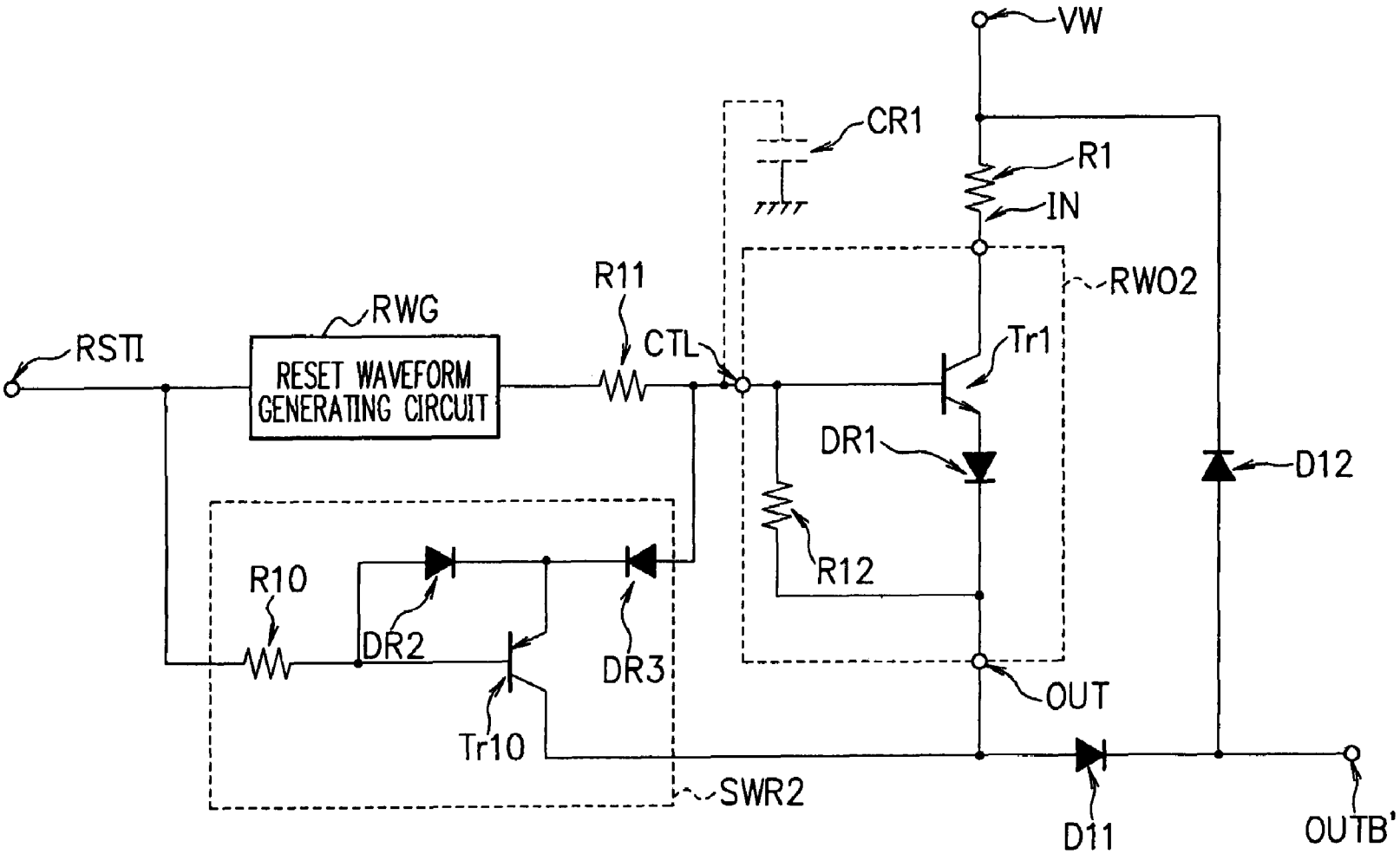
FIG. 6 is a diagram showing a configuration example of a reset circuit of a driving circuit according to a third embodiment.

FIG. 6 is a diagram showing a configuration example of the reset circuit RC of the driving circuit according to the third embodiment. In the reset circuit RC in the third embodiment, diodes DR2 and DR3 are additionally provided in the reactive current preventing switch SWR1 in the second embodiment. In FIG. 6, constituent elements having the same functions as those shown in FIG. 5 are designated by the same numerals and symbols, and a duplicate explanation is omitted.

In FIG. 6, SWR2 denotes a reactive current preventing switch and includes the diodes DR2 and DR3 in addition to the pnp transistor Tr10 and the resistance R1. The emitter terminal of the transistor Tr10 is connected to a cathode terminal of the diode DR3, and an anode terminal of the diode DR3 is connected to the control terminal CTL of the reset waveform output circuit RWO2. An anode terminal of the diode DR2 is connected to an interconnection node between the base terminal of the transistor Tr10 and the resistance R10, and a cathode terminal thereof is connected to an interconnection node between the emitter terminal of the transistor Tr10 and the cathode terminal of the diode DR3.

The diode DR2 is provided to prevent a withstand voltage from being applied between a base and an emitter of the transistor Tr10, that is to say, to ensure the voltage rating between the base and the emitter of the transistor Tr10. Even if the voltage of the reset signal VR1 is high, and the voltage exceeding the voltage rating between the base and the emitter of the transistor Tr10 is inputted, by providing the diode DR2, the voltage applied between the base and the emitter of the transistor Tr10 can be decreased by the diode DR2, whereby it becomes possible to operate the transistor Tr10 stably in a safe operation region.

If only the diode DR2 is provided in this case, there is a possibility that when a current flows through the control terminal CTL of the reset waveform output circuit RWO2 (the base terminal of the transistor Tr1) via the resistance R10 and the diode DR2, the signal VR2 outputted from the reset waveform generating circuit RWG via the resistance R11 cannot be transmitted to the reset waveform output circuit RWO2 as designed. Hence, by providing the diode DR3, the current is prevented from flowing through the control terminal CTL of the reset waveform output circuit RWO2 vi1 the resistance R10 and the diode DR2.

Consequently, even when the resistance value of the resistance R10 in the reactive current preventing switch SWR2 is made sufficiently small, the same effect as that obtained in the second embodiment can be obtained, and a normal operation can be maintained without the function of outputting a reset waveform being impaired.

Fourth Embodiment

Next, the fourth embodiment of the present invention will be described.

Figure 7:
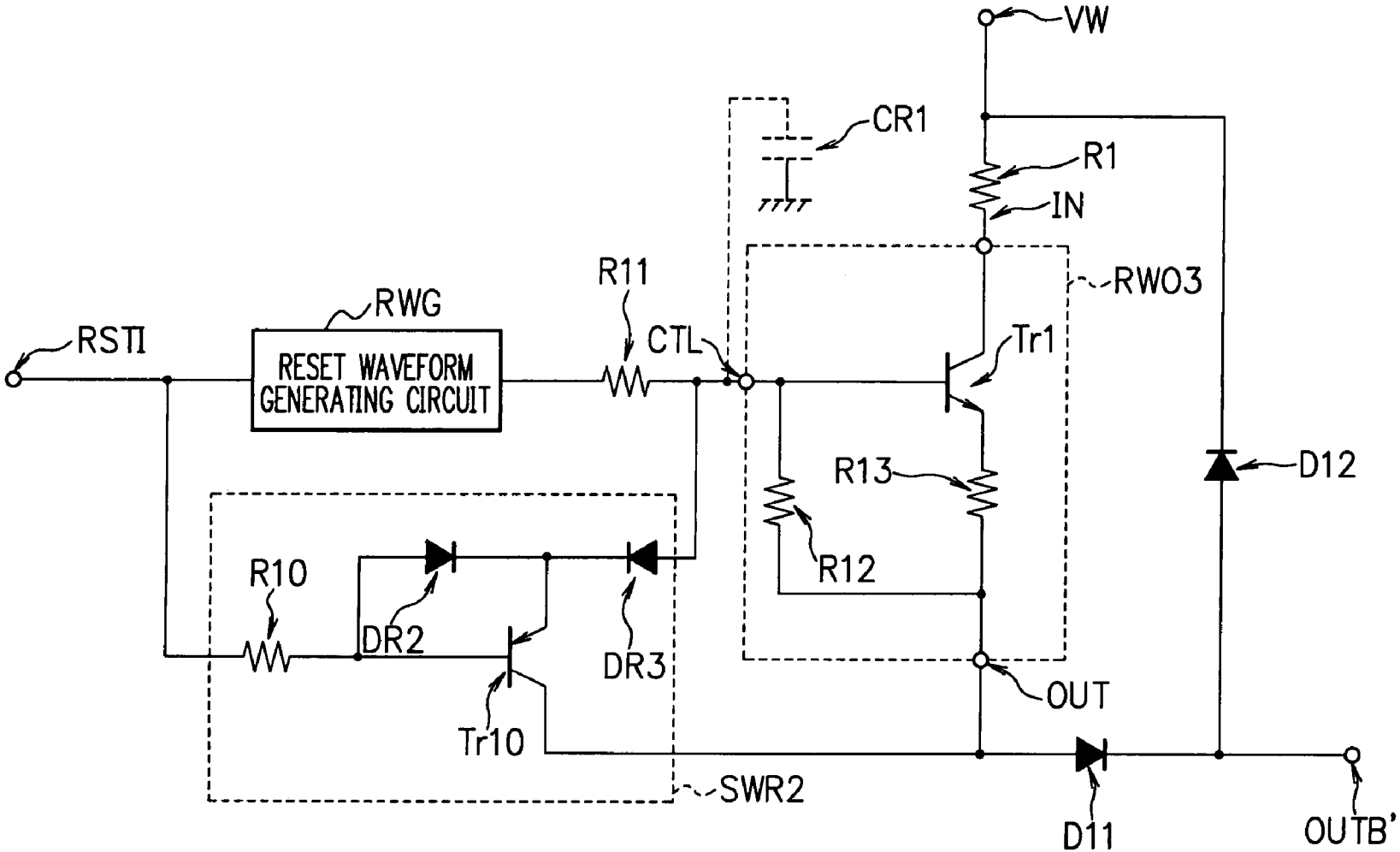
FIG. 7 is a diagram showing a configuration example of a reset circuit of a driving circuit according to a fourth embodiment.

FIG. 7 is a diagram showing a configuration example of the reset circuit RC of the driving circuit according to the fourth embodiment. In the reset circuit RC in the fourth embodiment, a resistance R13 is used in place of the diode DR1 in the reset waveform output circuit RWO2 in the third embodiment. In FIG. 7, constituent elements having the same functions as those shown in FIG. 6 are designated by the same numerals and symbols, and a duplicate explanation is omitted.

In FIG. 7, RWO3 denotes a reset waveform output circuit and includes the npn transistor Tr1, the resistance R12, and the resistance R13. The emitter terminal of the transistor Tr1 is connected to the output terminal OUT via the resistance R13. One end of the resistance R12 is connected to the base terminal of the transistor Tr1 and the other end thereof is connected to an interconnection node between the resistance R13 and the output terminal OUT.

In the reset circuit in the fourth embodiment shown in FIG. 7, by providing the resistance R13, a potential difference between the base terminal of the transistor Tr1 and the output terminal OUT can be made higher to thereby make it more difficult for the reactive current to flow through the transistor Tr1, which can prevent the reactive current from flowing. Moreover, even if the reactive current flows through the transistor Tr1, the voltage at both ends of the resistance R13 increases (voltage drop caused by the resistance R13 increases) with an increase in the quantity of the reactive current, the reactive current can be prevented from flowing by performing a negative feedback operation such as makes it more difficult for the reactive current to flow. Accordingly, the same effect as that in the first to third embodiments can be obtained.

Figure 8A:
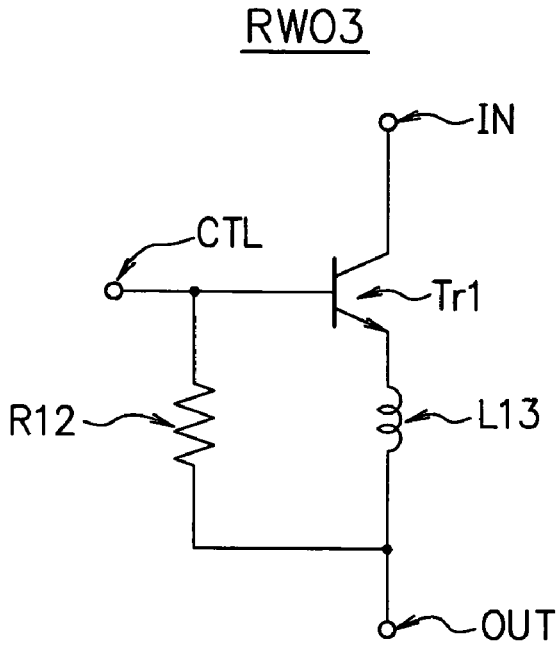
FIG. 8A and FIG. 8B are diagrams showing other configuration examples of a reset waveform output circuit in the fourth embodiment.
Figure 8B:
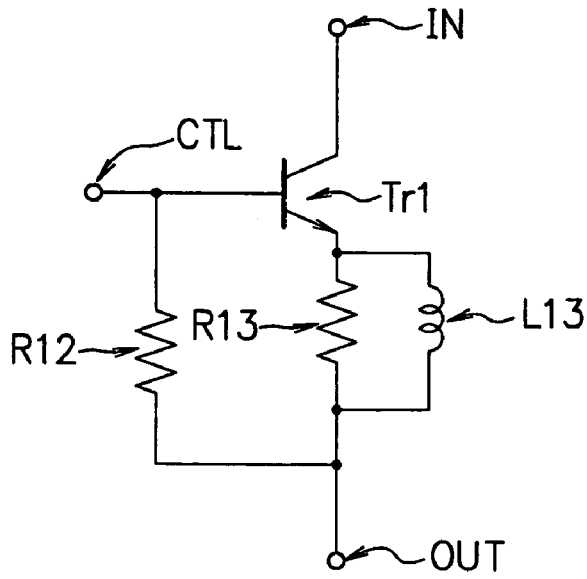

Incidentally, the resistance R13 is used in the reset waveform output circuit RWO3 shown in FIG. 7, but as shown in FIG. 8A, the reset waveform output circuit RWO3 may be configured using an inductance L13 in place of the resistance R13, or as shown in FIG. 8B, the reset waveform output circuit RWO3 may be configured by additionally connecting the inductance L13 in parallel with the resistance R13.

If the reset waveform output circuit RWO3 is configured as shown in FIG. 8A and FIG. 8B, it becomes possible to raise an impedance against a high-frequency component of the reactive current flowing through the transistor Tr1 to thereby make it more difficult for the reactive current to flow. The current flowing through the transistor Tr1 during the reset pulse output period TRP here is a low-frequency component which rises gently, and hence it is not easily influenced by the inductance L13.

Fifth Embodiment

Next, the fifth embodiment of the present invention will be described.

Figure 9:
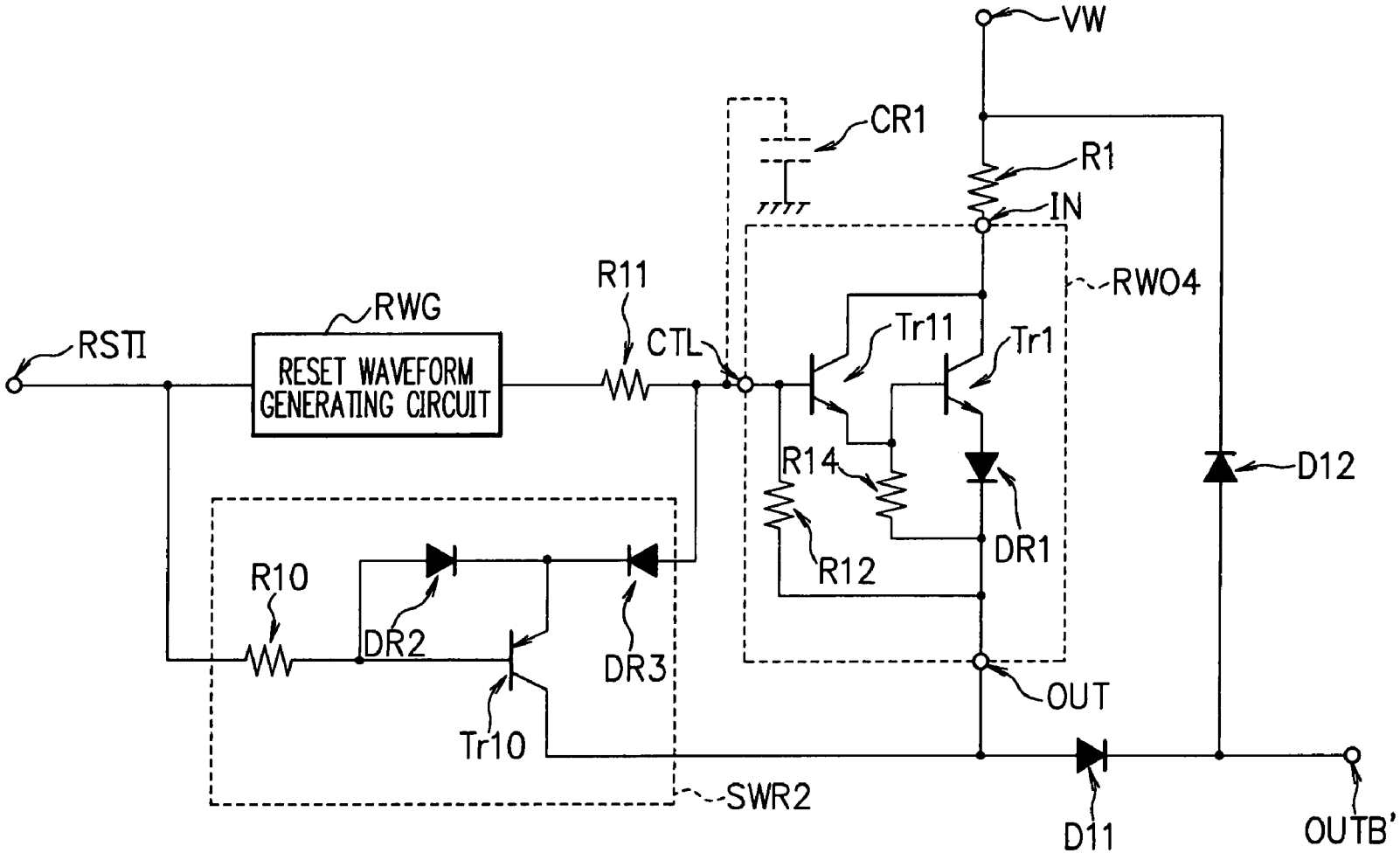
FIG. 9 is a diagram showing a configuration example of a reset circuit of a driving circuit according to a fifth embodiment.

FIG. 9 is a diagram showing a configuration example of the reset circuit RC of the driving circuit according to the fifth embodiment. In the reset circuit RC in the fifth embodiment, a transistor Tr11 and a resistance R14 are additionally provided in the reset waveform output circuit RWO2 in the third embodiment. In FIG. 9, constituent elements having the same functions as those shown in FIG. 6 are designated by the same numerals and symbols, and a duplicate explanation is omitted.

In FIG. 9, RWO4 denotes a reset waveform output circuit and includes the npn transistors Tr1 and Tr11, the resistances R12 and R14, and the diode DR1. A base terminal of the transistor Tr11 is connected to the control terminal CTL, and an emitter terminal thereof is connected to the base terminal of the transistor Tr1. Collector terminals of the transistors Tr1 and Tr11 are connected in common to the input terminal IN. Namely, the transistors Tr11 and Tr1 in the reset waveform output circuit RWO4 are configured a Darlington pair. Accordingly, the reset waveform output circuit RWO4 in the fifth embodiment can increase the current amplification as compared with the reset waveform output circuits RWO1 to RWO3 in the first to fourth embodiments.

The resistance R12 is connected between the base terminal of the transistor Tr11 and the cathode terminal of the diode DR1, and the resistance R14 is connected between an interconnection node between the emitter terminal of the transistor Tr11 and the base terminal of the transistor Tr1 and the cathode terminal of the diode DR1.

According to the fifth embodiment, the same effect as that in the third embodiment can be obtained, and the current amplification in the reset waveform output circuit RWO4 increases, so that the reset pulse RP without any waveform distortion can be outputted even if the load (a collector current which flows through the transistor Tr1, a current which flows out of the fourth signal line OUTB') increases, whereby the reset pulse RP which is stable against load change can be outputted. Moreover, by providing the resistance R14 to supply a bias current to the transistor Tr11, the operation can be further stabilized against variations in parts of the transistor Tr11, changes in ambient temperature, and so on.

Sixth Embodiment

Next, the sixth embodiment of the present invention will be described.

Figure 10:
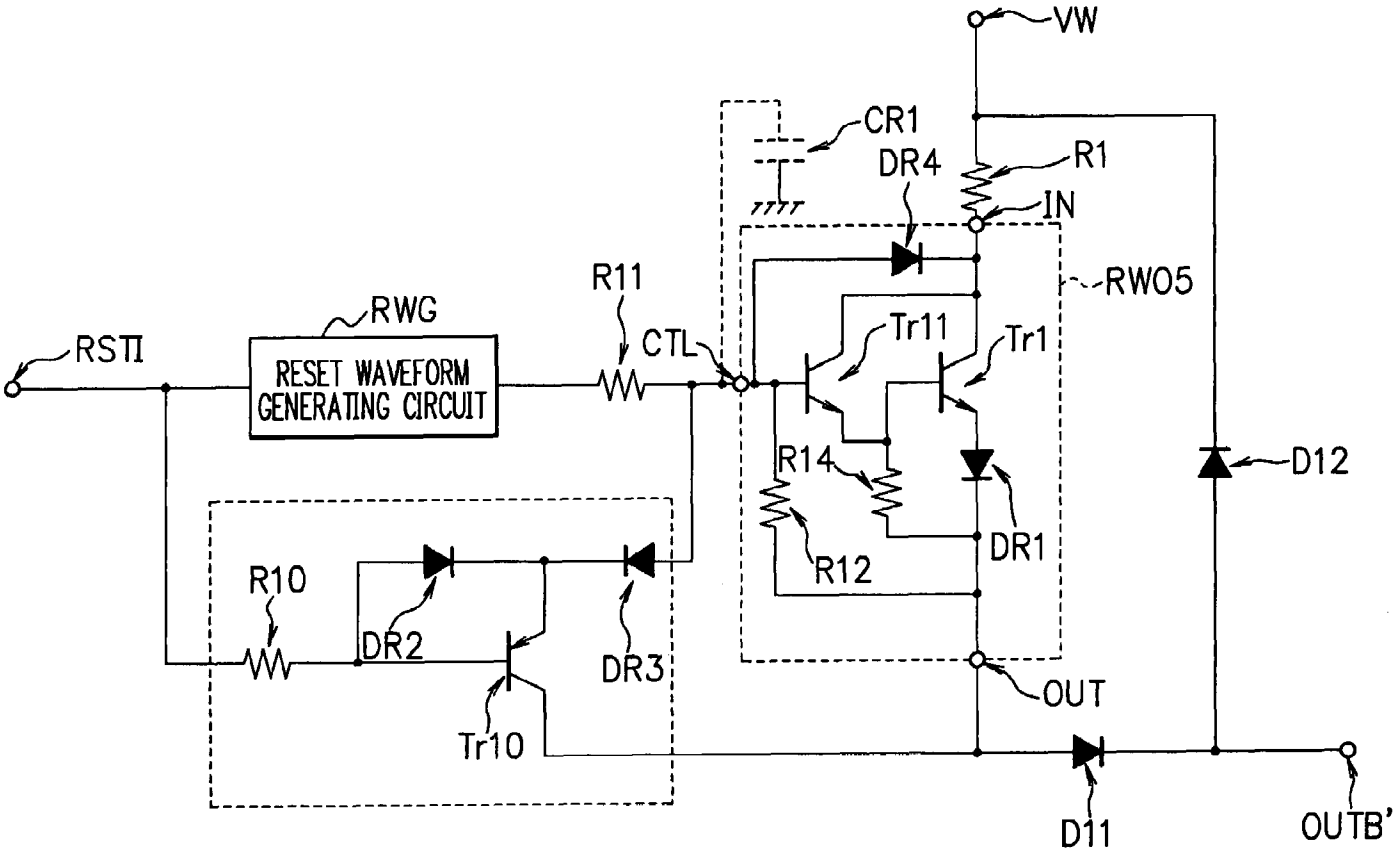
FIG. 10 is a diagram showing a configuration example of a reset circuit of a driving circuit according to a sixth embodiment.

FIG. 10 is a diagram showing a configuration example of the reset circuit RC of the driving circuit according to the sixth embodiment. In the reset circuit RC in the sixth embodiment, a diode DR4 is additionally provided in the reset waveform output circuit RWO4 in the fifth embodiment. In FIG. 10, constituent elements having the same functions as those shown in FIG. 9 are designated by the same numerals and symbols, and a duplicate explanation is omitted.

In FIG. 10, RWO5 denotes a reset waveform output circuit and includes the npn transistors Tr1 and Tr11, the resistances R12 and R14, and the diodes DR1 and DR4. An anode terminal of the diode DR4 is connected to the base terminal of the transistor Tr11, and a cathode terminal thereof is connected to an interconnection node between the collector terminals of the transistors Tr1 and Tr11.

When the transistors Tr1 and Tr11 are turned on, the diode DR4 prevents the potentials of the collector terminals from becoming lower than those of the base terminals, so that the transistors Tr1 and Tr11 become difficult to saturate. Consequently, when the transistors Tr1 and Tr11 are turned off after the transistors Tr1 and Tr11 are turned on and the reset pulse RP is outputted in the reset pulse output period TRP, the time necessary for the change from "on" to "off" can be reduced. Accordingly, in addition to the effect obtained in the fifth embodiment, a reduction in heat generation caused by power loss in the transistors Tr1 and Tr11 can be achieved.

Incidentally, the anode terminal of the diode DR4 is connected to the base terminal of the transistor Tr11 in the above embodiment, but it may be connected to the collector terminal of the transistor Tr11.

Seventh Embodiment

Next, the seventh embodiment of the present invention will be described.

Figure 11:
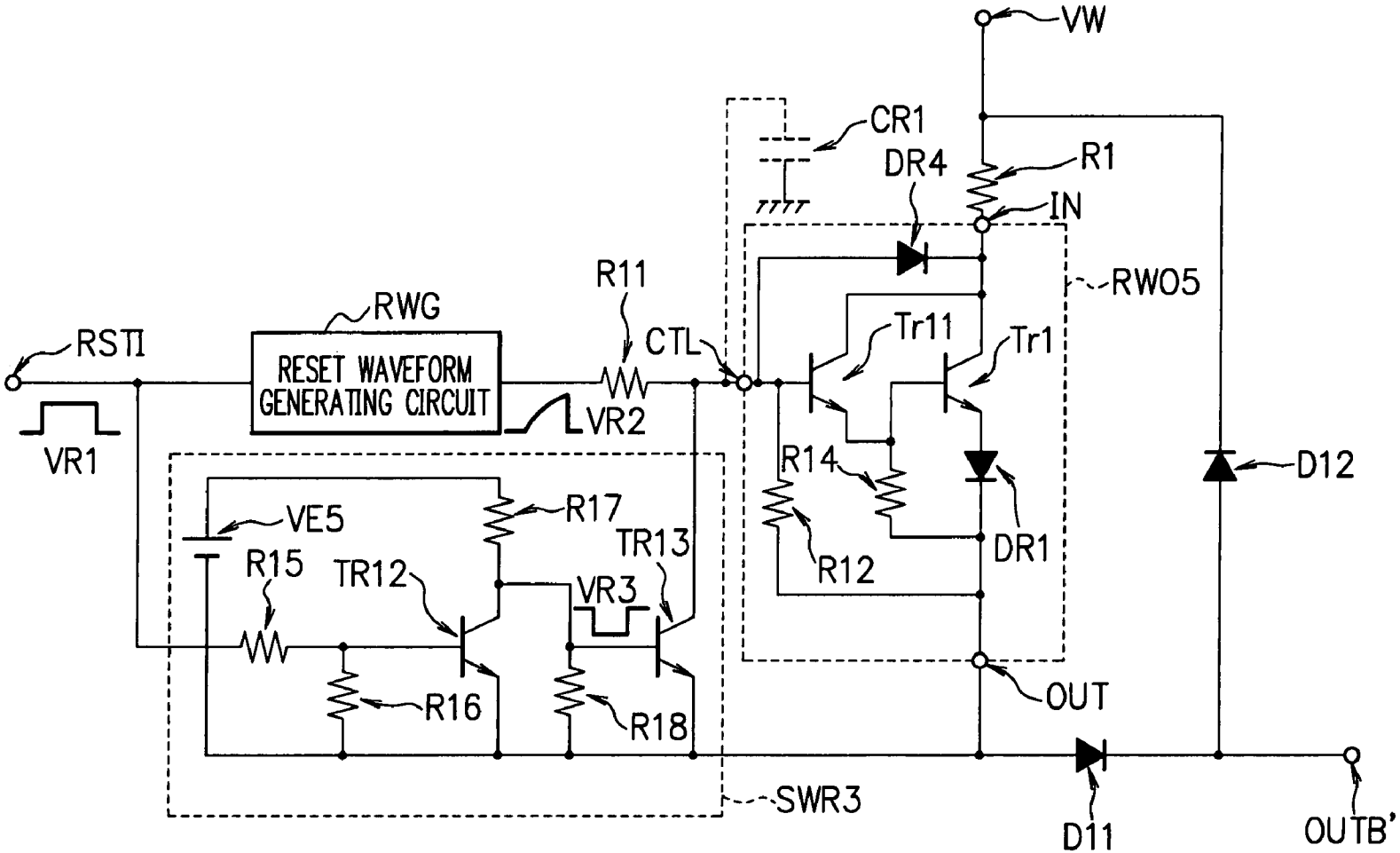
FIG. 11 is a diagram showing a configuration example of a reset circuit of a driving circuit according to a seventh embodiment.

FIG. 11 is a diagram showing a configuration example of the reset circuit RC of the driving circuit according to the seventh embodiment. In the reset circuit RC in the seventh embodiment, the reactive current preventing switch SWR2 in the sixth embodiment is configured using npn transistors. In FIG. 11, constituent elements having the same functions as those shown in FIG. 10 are designated by the same numerals and symbols, and a duplicate explanation is omitted.

In FIG. 11, SWR3 denotes a reactive current preventing switch and includes npn transistors Tr12 and Tr13, resistances R15, T16, R17, and R18, and a voltage source VE5. A collector terminal of the transistor Tr12 is connected to the high potential side of the voltage source VE5 via the resistance R17, and a base terminal thereof is connected to the reset signal input terminal RSTI via the resistance R15. A collector terminal of the transistor Tr13 is connected to the control terminal CTL of the reset waveform output circuit RWO5, and a base terminal thereof is connected to an interconnection node between the collector terminal of the transistor Tr12 and the resistance R17. Emitter terminals of the transistors Tr12 and Tr13 are connected to an interconnection node between the output terminal OUT of the reset waveform output circuit RWO5 and the anode terminal of the diode D11.

One end of the resistance R16 is connected to an interconnection node between the base terminal of the transistor Tr12 and the resistance R15, and the other end thereof is connected to the emitter terminal of the transistor Tr12. One end of the resistance R18 is connected to an interconnection node between the base terminal of the transistor Tr13 and the collector terminal of the transistor Tr12, and the other end thereof is connected to the emitter terminal of the transistor Tr13.

According to the seventh embodiment, by inverting the reset signal VR1 and supplying it as the control signal VR3 to the base terminal of the transistor Tr13, the transistor Tr13 is turned off during the reset pulse output period TRP (period when the reset signal VR1 is activated and high level), whereas it is turned on during the other periods (containing a period when a current flows through the coil LA' such as a period between the points in time t11 and t12 shown in FIG. 3). Consequently, the control terminal CTL of the reset waveform output circuit RWO5 and the output terminal OUT are brought into a conducting state during periods other than the reset pulse output period TRP, which prevents the reactive current from flowing through the transistor Tr1. Accordingly, an increase in power consumption caused by the reactive current can be prevented, and heat generation caused by the reactive current can be also prevented, thereby leading to an improvement in the reliability of the driving circuit. Further, according to the seventh embodiment, when the reactive current preventing switch SWR3 is brought into conduction, a potential difference between the control terminal CTL of the reset waveform output circuit RWO5 and the output terminal OUT can be made greatly smaller as compared with the first to sixth embodiments (when the reactive current preventing switch is configured using the pnp transistor).

Other Embodiments

Figure 12:
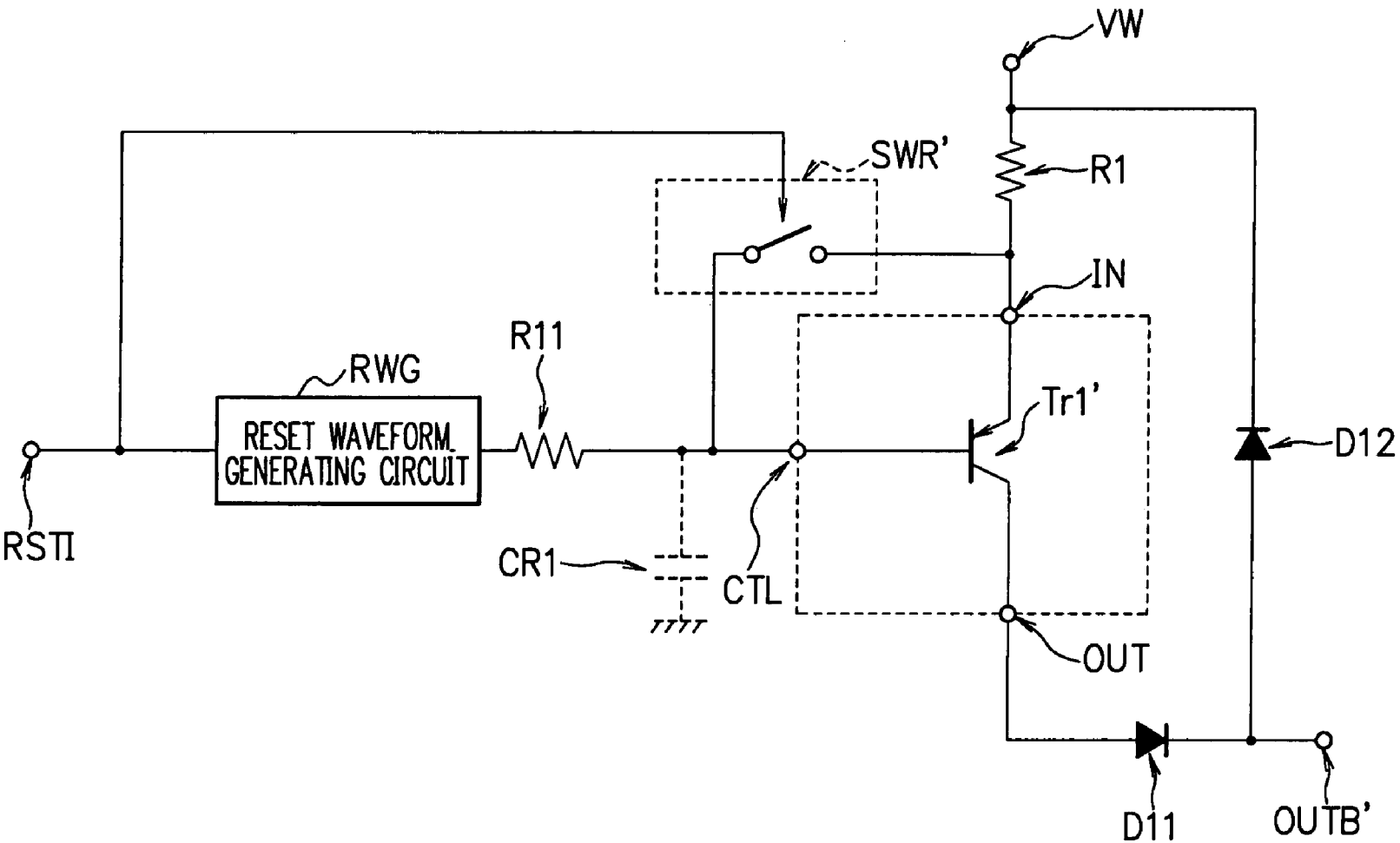
FIG. 12 is a diagram showing a configuration example of a reset circuit of a driving circuit according to another embodiment of the present invention.

Incidentally, in each of the aforementioned first to seventh embodiments, the reset waveform output circuit in the reset circuit RC in the driving circuit is configured using the npn transistor Tr1, but as shown in FIG. 12, it may be configured using a pnp transistor Tr1'. When a reset waveform output circuit RWO' is configured using the transistor Tr1' whose emitter terminal is connected to the input terminal IN, whose base terminal is connected to the control terminal CTL, and whose collector terminal is connected to the output terminal OUT as shown in FIG. 12, it is required to provide a reactive current preventing switch SWR' between the input terminal IN and the control terminal CTL. The same effect as that in the aforementioned embodiments can be obtained by performing on/off control of the reactive current preventing switch SWR', for example, by using the reset signal VR1 inputted from the reset signal input terminal RSTI.

In the aforementioned first to seventh embodiments, the driving circuit such as shown in FIG. 1, in which the coil circuit A' supplying electric charge to the load 20 is connected to the third signal line OUTA' and the coil circuit B' discharging electric charge from the load 20 is connected to the fourth signal line OUTB' is explained as an example, but the present invention is not limited to this example.

Figure 13:
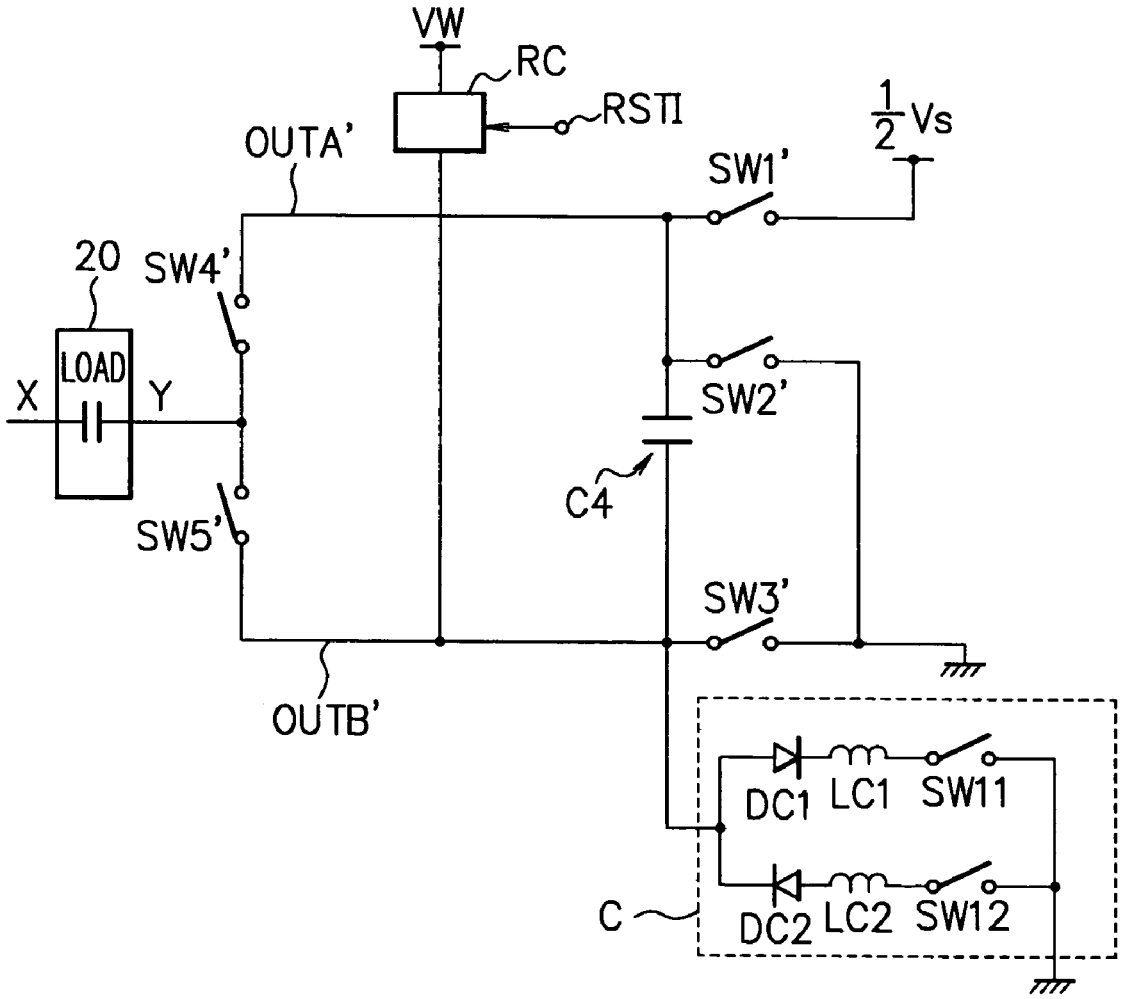
FIG. 13 and FIG. 14 are diagrams showing configuration examples of a driving circuit according to another embodiment of the present invention.

The present invention is also applicable, for example, to a driving circuit in which a coil circuit C having both a function of supplying electric charge to the load 20 and a function of discharging electric charge from the load 20 is connected to the fourth signal line OUTB' as shown in FIG. 13.

FIG. 13 is a diagram showing a configuration example of the driving circuit according to this embodiment. In FIG. 13, constituent elements having the same functions as those shown in FIG. 1 are designated by the same numerals and symbols, and a duplicate explanation is omitted.

In FIG. 13, the coil circuit C includes diodes DC1 and DC2, coils LC1 and LC2, and switches SW11 and SW12. The function of discharging electric charge from the load 20 is realized by the diode DC1, the coil LC1, and the switch SW11. An anode terminal of the diode DC1 is connected to the fourth signal line OUTB', and a cathode terminal thereof is connected to the ground via the coil LC1 and the switch SW11. Similarly, the function of supplying electric charge to the load 20 is realized by the diode DC2, the coil LC2, and the switch SW12. A cathode terminal of the diode DC2 is connected to the fourth signal line OUTB', and an anode terminal thereof is connected to the ground via the coil LC and the switch SW12.

Figure 14:
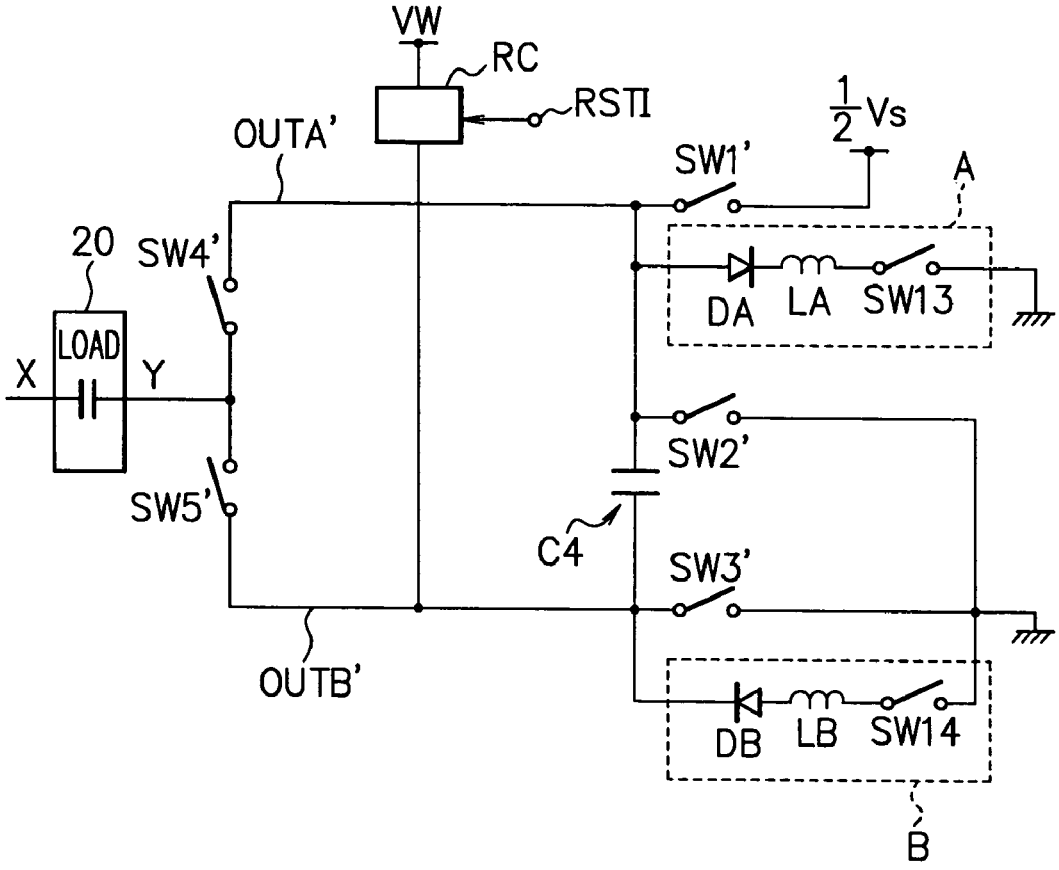

Further, the present invention is also applicable, for example, to a driving circuit, in which a coil circuit A which discharges electric charge from the load 20 is connected to the third signal line OUTA' and a coil circuit B which supplies electric charge to the load 20 is connected to the fourth signal line OUTB', as shown in FIG. 14.

FIG. 14 is a diagram showing a configuration example of the driving circuit according to this embodiment. In FIG. 14, constituent elements having the same functions as those shown in FIG. 1 are designated by the same numerals and symbols, and a duplicate explanation is omitted.

In FIG. 14, the coil circuit A includes a diode DA, a coil LA, and a switch SW13. An anode terminal of the diode DA is connected to an interconnection node between the first and second switches SW1' and SW2' (the third signal line OUTA'), a cathode terminal thereof is connected to the ground via the coil LA and the switch SW13. The coil circuit B includes a diode DB, a coil LB, and a switch SW14. A cathode terminal of the diode DB is connected to an interconnection node between the third switch SW3' and the other terminal of the capacitor C4 (the fourth signal line OUTB'), and an anode terminal thereof is connected to the ground via the coil LB and the switch SW14.

In the aforementioned first to seventh embodiments, a case where the reset circuit RC is provided on the scan electrode Y side is shown as an example, but the aforementioned embodiments can be freely applied also to a case where the reset circuit is provided on the common electrode X side.

Furthermore, a combination of the reset waveform output circuits RWO1 to RWO5 and the reactive current preventing switches SWR1 to SWR3 in the reset circuit is optional without being limited to those in the reset circuits in the driving circuits shown in the first to seventh embodiments.

The present embodiments are to be considered in all respects as illustrative and no restrictive, and all changes which come within the meaning and range of equivalency of the claims are therefore intended to be embraced therein.

The invention may be embodied in other specific forms without departing from the spirit or essential characteristics thereof.

According to the present invention, during a period when a reactive current is prevented from flowing, a waveform output circuit is controlled so as not to operate by bringing a reactive current preventing switch into conduction to thereby prevent the reactive current from flowing, and consequently an increase in power consumption and damage to elements caused by heat generation can be prevented. Accordingly, the reliabilities of a driving circuit and a plasma display device using the driving circuit can be improved.

What is claimed is:

1. A driving circuit of a matrix type flat panel display device, wherein said driving circuit applies a voltage to a capacitive load, comprising:

a first signal line supplying a first potential to one end of the capacitive load;

a second signal line supplying a second potential to the one end of the capacitive load;

a waveform output circuit having an input terminal, an output terminal, and a control terminal, wherein the input terminal is connected to a supply line supplying a third potential, wherein the output terminal is connected to said first signal line or said second signal line, and wherein the control terminal is connected to a waveform generating circuit; and a reactive current preventing switch connected between the control terminal and the output terminal or the input terminal of said waveform output circuit.

2. The driving circuit according to claim 1, wherein said waveform output circuit comprises a first npn transistor whose collector terminal, emitter terminal, and base terminal are respectively connected to the input terminal, the output terminal, and the control terminal of said waveform output circuit.

3. The driving circuit according to claim 2, wherein said waveform output circuit further comprises a first diode whose anode is connected to the emitter terminal of the first npn transistor, and whose cathode is connected to the output terminal of said waveform output circuit.

4. The driving circuit according to claim 3, wherein said waveform output circuit further comprises a second npn transistor, wherein the first and second npn transistor are connected in a Darlington configuration.

5. The driving circuit according to claim 4, wherein said waveform output circuit further comprises a second diode whose anode is connected to the control terminal and whose cathode is connected to the input terminal.

6. The driving circuit according to claim 2, wherein said waveform output circuit further comprises at least either one of a resistance or a coil which is connected between the emitter terminal of the first npn transistor and the output terminal of said waveform output circuit, and the emitter terminal of the first npn transistor is connected to one end of the resistance or the coil or one ends of the resistance and the coil, and the output terminal is connected to the other end of the resistance or the coil or the other ends of the resistance and the coil.

7. The driving circuit according to claim 1, wherein said reactive current preventing switch comprises a pnp transistor whose emitter terminal is connected to the control terminal of said waveform output circuit and whose collector terminal is connected to the output terminal or the input terminal of said waveform output circuit.

8. The driving circuit according to claim 7, wherein said reactive current preventing switch further comprises:

a first diode whose anode is connected to a base terminal of the pnp transistor and whose cathode is connected to the emitter terminal thereof, and a second diode whose anode is connected to the control terminal of said waveform output circuit and whose cathode is connected to an interconnection node between the cathode of the first diode and the emitter terminal of the pnp transistor.

9. The driving circuit according to claim 1, wherein said reactive current preventing switch comprises an npn transistor whose collector terminal is connected to the control terminal of said waveform output circuit and whose emitter terminal is connected to the output terminal or the input terminal of said waveform output circuit.

10. The driving circuit according to claim 1, further comprising:

a first switch controlling a connection between the one end of the capacitive load and said first signal line;

a second switch controlling a connection between the one end of the capacitive load and said second signal line; and a coil circuit connected between at least either one of said first signal line or said second signal line and a supply line supplying a fourth potential, wherein at least one of said coil circuits is connected in series with said first switch or said second switch.

11. The driving circuit according to claim 10, wherein said coil circuit comprises:

a charging circuit connected to said first signal line and supplying electric charge to the capacitive load through said first signal line; and a discharge circuit connected to said second signal line and discharging electric charge from the capacitive load through said second signal line.

12. The driving circuit according to claim 10, wherein said coil circuit comprises:

a charging circuit connected to said second signal line and supplying electric charge to the capacitive load through said second signal line; and a discharge circuit discharging electric charge from the capacitive load through said second signal line.

13. The driving circuit according to claim 10, wherein said coil circuit comprises:

a charging circuit connected to said second signal line and supplying electric charge to the capacitive load through said second signal line; and a discharge circuit connected to said first signal line and discharging electric charge from the capacitive load through said first signal line.

14. A driving circuit of a matrix type flat panel display device, wherein said driving circuit applies a voltage to a capacitive load, comprising:

a first and second switches connected between a first power supply supplying a first potential and a second potential different from the first potential and a second power supply supplying a third potential;

a capacitor whose one terminal is connected halfway between said first and second switches;

a third switch connected between the other terminal of said capacitor and the second power supply;

a first signal line connected to the one terminal of said capacitor and supplying the first potential;

a second signal line connected to the other terminal of said capacitor and supplying the second potential;

a coil circuit connected between at least either one of said first signal line or said second signal line and the second power supply;

a waveform output circuit whose input terminal is connected to a third power supply supplying a fourth potential, whose output terminal is connected to said first signal line or said second signal line, and whose control terminal is connected to a waveform generating circuit; and a reactive current preventing switch connected between the control terminal and the output terminal or the input terminal of said waveform output circuit.

15. The driving circuit according to claim 14, wherein said reactive current preventing switch is in a conducting state during a period when a current is flowing through said coil circuit.

16. The driving circuit according to claim 14, wherein said waveform output circuit comprises an npn transistor whose collector terminal, emitter terminal, and base terminal are respectively connected to the input terminal, the output terminal, and the control terminal of said waveform output circuit.

17. The driving circuit according to claim 16, wherein said waveform output circuit further comprises a diode whose anode is connected to the emitter terminal of the npn transistor, and whose cathode is connected to the output terminal of said waveform output circuit.

18. The driving circuit according to claim 16, wherein said waveform output circuit further comprises at least either one of a resistance or a coil which is connected between the emitter terminal of the npn transistor and the output terminal of said waveform output circuit, and the emitter terminal of the npn transistor is connected to one end of the resistance or the coil or one ends of the resistance and the coil, and the output terminal is connected to the other end of the resistance or the coil or the other ends of the resistance and the coil.

19. The driving circuit according to claim 14, wherein said reactive current preventing switch is a pnp transistor whose emitter terminal is connected to the control terminal of said waveform output circuit and whose collector terminal is connected to the output terminal or the input terminal of said waveform output circuit.

20. The driving circuit according to claim 14, wherein said reactive current preventing switch is an npn transistor whose collector terminal is connected to the control terminal of said waveform output circuit and whose emitter terminal is connected to the output terminal or the input terminal of said waveform output circuit.

21. A driving method using a driving circuit of a matrix type flat panel display device which applies a voltage to a capacitive load, wherein the driving circuit comprises:

a first signal line supplying a first potential to one end of the capacitive load;

a second signal line supplying a second potential to the one end of the capacitive load;

a coil circuit including a coil connected to at least either one of said first signal line or said second signal line;

a first switch controlling a connection between the one end of the capacitive load and said first signal line;

a second switch controlling a connection between the one end of the capacitive load and said second signal line;

a third switch controlling a connection between a first power supply line supplying a reference potential which is a reference of the first potential to said first signal line and said first signal line;

a waveform output circuit whose input terminal is connected to a supply line supplying a third potential, whose output terminal is connected to said first signal line or said second signal line, and whose control terminal is connected to a waveform generating circuit; and a reactive current preventing switch connected between the control terminal and the output terminal or the input terminal of said waveform output circuit, and said third switch is turned on, after said first switch is turned on and resonance occurs between the coil and the capacitive load.

22. A driving method using a driving circuit of a matrix type flat panel display device which applies a voltage to a capacitive load, wherein the driving circuit comprises:

a first signal line supplying a first potential to one end of the capacitive load;

a second signal line supplying a second potential to the one end of the capacitive load;

a coil circuit including a coil connected to at least either one of said first signal line or said second signal line;

a first switch controlling a connection between the one end of the capacitive load and said first signal line;

a second switch controlling a connection between the one end of the capacitive load and said second signal line;

a third switch controlling a connection between a first power supply line supplying a reference potential which is a reference of the second potential to said second signal line and said second signal line;

a waveform output circuit whose input terminal is connected to a supply line supplying a third potential, whose output terminal is connected to said first signal line or said second signal line, and whose control terminal is connected to a waveform generating circuit; and a reactive current preventing switch connected between the control terminal and the output terminal or the input terminal of said waveform output circuit, and said third switch is turned on, after said second switch is turned on and resonance occurs between the coil and the capacitive load.

23. A plasma display device, comprising:

a plurality of X electrodes;

a plurality of Y electrodes arranged substantially parallel to said plurality of X electrodes and generating electric discharge with said plurality of X electrodes;

an X electrode driving circuit applying a discharge voltage to said plurality of X electrodes; and a Y electrode driving circuit applying a discharge voltage to said plurality of Y electrodes, wherein said X electrode driving circuit or said Y electrode driving circuit comprises the driving circuit according to claim 1.

24. The plasma display device according to claim 23, wherein said waveform output circuit is a reset voltage output circuit which supplies a reset voltage to initialize display cells formed by said plurality of X electrodes and said plurality of Y electrodes.

25. A plasma display device, comprising:

a plurality of X electrodes;

a plurality of Y electrodes arranged substantially parallel to said plurality of X electrodes and generating electric discharge with said plurality of X electrodes;

an X electrode driving circuit applying a discharge voltage to said plurality of X electrodes; and a Y electrode driving circuit applying a discharge voltage to said plurality of Y electrodes, wherein said X electrode driving circuit or said Y electrode driving circuit comprises a reset waveform output circuit which includes an output terminal outputting a reset voltage to reset display cells formed by said plurality of X electrodes and said plurality of Y electrodes, an input terminal connected to a reset power supply, and a control terminal connected to a reset waveform generating circuit, and a reactive current preventing switch connected between the control terminal and the output terminal or the input terminal of the reset waveform output circuit.

* * * * *

UNITED STATES PATENT AND TRADEMARK OFFICE

CERTIFICATE OF CORRECTION

PATENT NO. : 7,307,603 B2
APPLICATION NO. : 10/956161
DATED : December 11, 2007
INVENTOR(S) : Makoto Onozawa et al.

It is certified that error appears in the above-identified patent and that said Letters Patent is hereby corrected as shown below:

On the title page item (56), Column 2 under (Other Publications), Line 1, change "Drving" to --Driving--.

Signed and Sealed this

Twenty-seventh Day of May, 2008

JON W. DUDAS
*Director of the United States Patent and Trademark Office*